US009366090B2

(12) United States Patent
Azar et al.

(10) Patent No.: US 9,366,090 B2
(45) Date of Patent: Jun. 14, 2016

(54) KERFING HYBRID DRILL BIT AND OTHER DOWNHOLE CUTTING TOOLS

(75) Inventors: Michael G. Azar, The Woodlands, TX (US); Bala Durairajan, Houston, TX (US); Madapusi K. Keshavan, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 1026 days.

(21) Appl. No.: 13/370,734

(22) Filed: Feb. 10, 2012

(65) Prior Publication Data

US 2012/0205163 A1 Aug. 16, 2012

Related U.S. Application Data

(60) Provisional application No. 61/441,319, filed on Feb. 10, 2011, provisional application No. 61/499,851, filed on Jun. 22, 2011.

(51) Int. Cl.
*E21B 10/62* (2006.01)
*E21B 10/43* (2006.01)
(Continued)

(52) U.S. Cl.
CPC ..... *E21B 10/62* (2013.01); *E21B 10/26* (2013.01); *E21B 10/42* (2013.01); *E21B 10/43* (2013.01); *E21B 10/46* (2013.01); *E21B 10/54* (2013.01); *E21B 10/55* (2013.01); *E21B 10/56* (2013.01); *E21B 10/567* (2013.01); *E21B 10/5673* (2013.01); *E21B 10/627* (2013.01); *E21B 10/633* (2013.01); *E21B 2010/425* (2013.01);
(Continued)

(58) Field of Classification Search
CPC ..... E21B 10/5673; E21B 10/55; E21B 10/42; E21B 10/43; E21B 10/567; E21B 10/561; E21B 2010/425; E21B 2010/545; E21B 10/62
See application file for complete search history.

(56) References Cited

U.S. PATENT DOCUMENTS 2,941,241 A 6/1960 Strong
2,941,248 A 6/1960 Hall
(Continued)

FOREIGN PATENT DOCUMENTS

BE 1014561 A3 12/2003
CN 2227191 Y 5/1996
(Continued)

OTHER PUBLICATIONS

Office Action issued in corresponding Chinese Application No. 201280008571.9, mailed Mar. 23, 2015 (16 pages).
(Continued)

*Primary Examiner* — Jennifer H Gay
*Assistant Examiner* — George Gray

(57) ABSTRACT

A drill bit for drilling a borehole in earth formations may include a bit body having a bit axis and a bit face; a plurality of blades extending radially along the bit face; and a plurality of cutting elements disposed on the plurality of blades. The plurality of cutting elements may include: at least one cutter including a substrate and a diamond table having a substantially planar cutting face; and at least two conical cutting elements including a substrate and a diamond layer having a conical cutting end. In a rotated view of the plurality of cutting elements into a single plane, the at least one cutter may be located a radial position from the bit axis that is intermediate the radial positions of the at least two conical cutting elements.

24 Claims, 18 Drawing Sheets

(51) Int. Cl.

| | |
|---|---|
| ***E21B 10/46*** | (2006.01) |
| ***E21B 10/54*** | (2006.01) |
| ***E21B 10/26*** | (2006.01) |
| ***E21B 10/55*** | (2006.01) |
| ***E21B 10/567*** | (2006.01) |
| *E21B 10/42* | (2006.01) |
| *E21B 10/56* | (2006.01) |
| *E21B 10/627* | (2006.01) |
| *E21B 10/633* | (2006.01) |

(52) U.S. Cl.

CPC ..... *E21B2010/545* (2013.01); *E21B 2010/561* (2013.01); *E21B 2010/562* (2013.01); *E21B 2010/622* (2013.01); *E21B 2010/624* (2013.01)

(56) References Cited

U.S. PATENT DOCUMENTS

| | | | | |
|---|---|---|---|---|
| 2,947,611 | A | 8/1960 | Bundy | |
| 3,609,818 | A | 10/1971 | Wentorf, Jr. | |
| 3,767,371 | A | 10/1973 | Wentorf, Jr. et al. | |
| 4,104,344 | A | 8/1978 | Pope et al. | |
| 4,224,380 | A | 9/1980 | Bovenkerk et al. | |
| 4,288,248 | A | 9/1981 | Bovenkerk et al. | |
| 4,289,503 | A | 9/1981 | Corrigan | |
| 4,525,178 | A | 6/1985 | Hall | |
| 4,640,374 | A | 2/1987 | Dennis | |
| 4,673,414 | A | 6/1987 | Lavens et al. | |
| 4,694,918 | A | 9/1987 | Hall | |
| 4,882,128 | A | 11/1989 | Hukvari et al. | |
| 4,933,529 | A | 6/1990 | Saville | |
| 4,954,139 | A | 9/1990 | Cerutti | |
| 5,369,034 | A | 11/1994 | Hargett et al. | |
| 5,370,195 | A | 12/1994 | Keshavan et al. | |
| 5,582,261 | A | 12/1996 | Keith et al. | |
| 5,655,614 | A | 8/1997 | Azar | |
| 5,695,019 | A | 12/1997 | Shamburger, Jr. | |
| 6,283,233 | B1 | 9/2001 | Lamine et al. | |
| 6,332,503 | B1 | 12/2001 | Pessier et al. | |
| 6,394,202 | B2 | 5/2002 | Truax et al. | |
| 6,440,224 | B1 | 8/2002 | Wei et al. | |
| 6,744,024 | B1 | 6/2004 | Hayes et al. | |
| 7,703,559 | B2 | 4/2010 | Shen et al. | |
| 7,748,475 | B2 | 7/2010 | McClain et al. | |
| 7,757,789 | B2 | 7/2010 | Yong et al. | |
| 7,845,438 | B1 | 12/2010 | Vail et al. | |
| 7,992,658 | B2 | 8/2011 | Buske | |
| 8,881,849 | B2 | 11/2014 | Zhang et al. | |
| 8,887,837 | B2 | 11/2014 | Azar et al. | |
| 2004/0094334 | A1 | 5/2004 | Singh | |
| 2006/0011388 | A1 | 1/2006 | Boudrare et al. | |
| 2006/0081402 | A1 | 4/2006 | Lockwood et al. | |
| 2007/0114071 | A1 | 5/2007 | Hall | |
| 2007/0221406 | A1 | 9/2007 | Hall et al. | |
| 2008/0017421 | A1 | 1/2008 | Lockwood | |
| 2008/0029312 | A1 | 2/2008 | Hall et al. | |
| 2008/0035380 | A1 | 2/2008 | Hall et al. | |
| 2008/0035387 | A1* | 2/2008 | Hall | E21B 10/43 175/426 |
| 2008/0099251 | A1 | 5/2008 | Hall et al. | |
| 2008/0173482 | A1 | 7/2008 | Hall et al. | |
| 2008/0185189 | A1 | 8/2008 | Griffo et al. | |
| 2008/0223623 | A1 | 9/2008 | Keshavan et al. | |
| 2008/0282618 | A1 | 11/2008 | Lockwood | |
| 2008/0314647 | A1* | 12/2008 | Hall | E21B 10/42 175/430 |
| 2009/0120008 | A1 | 5/2009 | Lockwood et al. | |
| 2009/0139150 | A1 | 6/2009 | Ras | |
| 2009/0145663 | A1 | 6/2009 | Durairajan et al. | |
| 2009/0145669 | A1 | 6/2009 | Durairajan et al. | |
| 2009/0152018 | A1 | 6/2009 | Sani | |
| 2010/0018780 | A1 | 1/2010 | Johnson et al. | |
| 2010/0059288 | A1 | 3/2010 | Hall et al. | |
| 2010/0065332 | A1 | 3/2010 | Hall et al. | |
| 2010/0065338 | A1 | 3/2010 | Hall et al. | |
| 2010/0065339 | A1 | 3/2010 | Hall et al. | |
| 2010/0071964 | A1 | 3/2010 | Hall et al. | |
| 2010/0089648 | A1 | 4/2010 | Hall et al. | |
| 2010/0101870 | A1 | 4/2010 | Shamburger | |
| 2010/0122013 | A1 | 5/2010 | Klaiber et al. | |
| 2010/0133013 | A1 | 6/2010 | Deschamps et al. | |
| 2010/0218999 | A1* | 9/2010 | Jones | E21B 10/55 175/413 |
| 2010/0219001 | A1 | 9/2010 | Shen et al. | |
| 2010/0276145 | A1 | 11/2010 | Dewey et al. | |
| 2010/0300673 | A1 | 12/2010 | Richert et al. | |
| 2010/0314176 | A1 | 12/2010 | Zhang et al. | |
| 2011/0048811 | A1 | 3/2011 | Hall et al. | |
| 2011/0192651 | A1* | 8/2011 | Lyons | E21B 10/5673 175/428 |
| 2011/0192653 | A1 | 8/2011 | Stowe, II | |
| 2011/0259650 | A1 | 10/2011 | Hall et al. | |
| 2011/0297454 | A1 | 12/2011 | Shen et al. | |
| 2012/0031674 | A1 | 2/2012 | Lyons | |
| 2012/0205163 | A1 | 8/2012 | Azar et al. | |
| 2012/0234610 | A1 | 9/2012 | Azar et al. | |
| 2012/0273280 | A1 | 11/2012 | Zhang et al. | |
| 2012/0273281 | A1 | 11/2012 | Burhan et al. | |
| 2013/0020134 | A1 | 1/2013 | Azar et al. | |

FOREIGN PATENT DOCUMENTS

| | | | |
|---|---|---|---|
| CN | 101310090 | A | 11/2008 |
| CN | 201269049 | Y | 7/2009 |
| CN | 101611211 | A | 12/2009 |
| EP | 0087283 | A1 | 8/1983 |
| EP | 0874128 | A2 | 10/1998 |
| GB | 2446512 | A | 8/2008 |
| JP | S59123772 | A | 7/1984 |
| JP | H11264088 | A | 9/1999 |
| RU | 2087666 | C1 | 8/1997 |
| RU | 2008115275 | A | 10/2009 |
| RU | 2009125622 | A | 1/2011 |
| SU | 1495427 | A1 | 7/1989 |
| WO | 2010011500 | A1 | 1/2010 |

OTHER PUBLICATIONS

Examiner's Report issued in Canadian Application No. 2826939; Dated Aug. 21, 2014 (3 pages).

International Report on Patentability issued in PCT/US2012/024609 mailed Aug. 22, 2013 (6 pages).

International Report on Patentability issued in PCT/US/2012/024606 mailed Aug. 22, 2013 (7 pages).

International Search Report and Written Opinion issued in corresponding International Application No. PCT/US2012/024609 dated May 17, 2012 (7 pages).

Office Action issued in related U.S. Appl. No. 12/826,193; Dated Nov. 25, 2013 (21 pages).

Combined Search and Examination Report under Sections 17 and 18(3) issued by the United Kingdom Intellectual Property Office on Mar. 11, 2010 in related Application No. GB0918411.0.

Examination Report issued in corresponding British Patent Application No. GB0918411.0; Dated Oct. 22, 2010 (3 pages).

Notice of Allowance issued in related U.S. Appl. No. 13/826,193; Dated Apr. 1, 2014 (11 pages).

International Search Report and Written Opinon issued in corresponding International Application No. PCT/US2012/024606 dated May 17, 2012 (8 pages).

Office Action issued in related U.S. Appl. No. 12/826,193; Dated Nov. 25, 2013 (11 pages).

Combined Search and Examination Report under Sections 17 and 18(3) issued by the United Kingdom Intellectual Property Office on Mar. 11, 2010 in related Application No. GB0918411.0 (7 pages).

Notice of Allowance issued in related U.S. Appl. No. 13/826,193; Dated Apr. 1, 2014 (5 pages).

Non-Final Office Action issued in related U.S. Appl. No. 13/370,862, mailed May 1, 2015 (7 pages).

Office Action issued in Chinese Application No. 201280008587.X; Dated May 6, 2015 (17 pages).

(56) References Cited

OTHER PUBLICATIONS

Office Action for related U.S. Appl. No. 12/826,193, Nov. 25, 2013, 10 pages.
Office Action for corresponding CA App No. 2827116, Oct. 16, 2014, 5 pages.
Office Action for corresponding CA App No. 2826939, Oct. 20, 2015, 4 pages.
Office Action for corresponding CN App No. 201280008571.9, Dec. 23, 2015, 5 pages.
Office Action issued in Chinese App No. 201280040733.7, May 6, 2015, 25 pages.
Office Action for corresponding EA App No. 201391150, Nov. 15, 2013, 3 pages.
Office Action for corresponding EA App No. 201391153, Nov. 18, 2015, 4 pages.
Notice of Allowance issued in related U.S. Appl. No. 13/826,193, Jul. 7, 2014, 5 pages.
International Preliminary Report on Patentability and Written Opinion issued in corresponding International App No. PCT/US2012/043305, Dec. 23, 2013, 4 pages.
International Search Report for corresponding International App No. PCT/US2012/043305, Dec. 6, 2012, 3 pages.
Non-Final Office Action issued in related U.S. Appl. No. 13/370,734, May 6, 2015, 11 pages.

* cited by examiner

KERFING HYBRID DRILL BIT AND OTHER DOWNHOLE CUTTING TOOLS

CROSS-REFERENCE TO RELATED APPLICATIONS

This application claims priority to U.S. Application No. 61/441,319, filed on Feb. 10, 2011, and U.S. Patent Application No. 61/499,851, filed on Jun. 22, 2011, both of which are herein incorporated by reference in their entirety.

BACKGROUND OF INVENTION

1. Field of the Invention

Embodiments disclosed herein generally relate to fixed cutter cutting tools containing hybrid cutting structures containing two or more types of cutting elements, each type having a different mode of cutting action against a formation. Other embodiments disclosed herein relate to fixed cutter cutting tools containing conical cutting elements, including the placement of such cutting elements on a bit and variations on the cutting elements that may be used to optimize drilling.

2. Background Art

In drilling a borehole in the earth, such as for the recovery of hydrocarbons or for other applications, it is conventional practice to connect a drill bit on the lower end of an assembly of drill pipe sections that are connected end-to-end so as to form a "drill string." The bit is rotated by rotating the drill string at the surface or by actuation of downhole motors or turbines, or by both methods. With weight applied to the drill string, the rotating bit engages the earthen formation causing the bit to cut through the formation material by either abrasion, fracturing, or shearing action, or through a combination of all cutting methods, thereby forming a borehole along a predetermined path toward a target zone.

Many different types of drill bits have been developed and found useful in drilling such boreholes. Two predominate types of drill bits are roller cone bits and fixed cutter (or rotary drag) bits. Most fixed cutter bit designs include a plurality of blades angularly spaced about the bit face. The blades project radially outward from the bit body and form flow channels therebetween. In addition, cutting elements are typically grouped and mounted on several blades in radially extending rows. The configuration or layout of the cutting elements on the blades may vary widely, depending on a number of factors such as the formation to be drilled.

The cutting elements disposed on the blades of a fixed cutter bit are typically formed of extremely hard materials. In a typical fixed cutter bit, each cutting element comprises an elongate and generally cylindrical tungsten carbide substrate that is received and secured in a pocked formed in the surface of one of the blades. The cutting elements typically includes a hard cutting layer of polycrystalline diamond (PCD) or other superabrasive materials such as thermally stable diamond or polycrystalline cubic boron nitride. For convenience, as used herein, reference to "PDC bit" "PDC cutters" refers to a fixed cutter bit or cutting element employing a hard cutting layer of polycrystalline diamond or other superabrasive materials.

Referring to FIGS. 1 and 2, a conventional fixed cutter or drag bit 10 adapted for drilling through formations of rock to form a borehole is shown. Bit 10 generally includes a bit body 12, a shank 13, and a threaded connection or pin 14 for connecting the bit 10 to a drill string (not shown) that is employed to rotate the bit in order to drill the borehole. Bit face 20 supports a cutting structure 15 and is formed on the end of the bit 10 that is opposite pin end 16. Bit 10 further includes a central axis 11 about which bit 10 rotates in the cutting direction represented by arrow 18.

Cutting structure 15 is provided on face 20 of bit 10. Cutting structure 15 includes a plurality of angularly spaced-apart primary blades 31, 32, 33, and secondary blades 34, 35, 36, each of which extends from bit face 20. Primary blades 31, 32, 33 and secondary blades 34, 35, 36 extend generally radially along bit face 20 and then axially along a portion of the periphery of bit 10. However, secondary blades 34, 35, 36 extend radially along bit face 20 from a position that is distal bit axis 11 toward the periphery of bit 10. Thus, as used herein, "secondary blade" may be used to refer to a blade that begins at some distance from the bit axis and extends generally radially along the bit face to the periphery of the bit. Primary blades 31, 32, 33 and secondary blades 34, 35, 36 are separated by drilling fluid flow courses 19.

Referring still to FIGS. 1 and 2, each primary blade 31, 32, 33 includes blade tops 42 for mounting a plurality of cutting elements, and each secondary blade 34, 35, 36 includes blade tops 52 for mounting a plurality of cutting elements. In particular, cutting elements 40, each having a cutting face 44, are mounted in pockets formed in blade tops 42, 52 of each primary blade 31, 32, 33 and each secondary blade 34, 35, 36, respectively. Cutting elements 40 are arranged adjacent one another in a radially extending row proximal the leading edge of each primary blade 31, 32, 33 and each secondary blade 34, 35, 36. Each cutting face 44 has an outermost cutting tip 44*a* furthest from blade tops 42, 52 to which cutting element 40 is mounted.

Referring now to FIG. 3, a profile of bit 10 is shown as it would appear with all blades (e.g., primary blades 31, 32, 33 and secondary blades 34, 35, 36) and cutting faces 44 of all cutting elements 40 rotated into a single rotated profile. In rotated profile view, blade tops 42, 52 of all blades 31-36 of bit 10 form and define a combined or composite blade profile 39 that extends radially from bit axis 11 to outer radius 23 of bit 10. Thus, as used herein, the phrase "composite blade profile" refers to the profile, extending from the bit axis to the outer radius of the bit, formed by the blade tops of all the blades of a bit rotated into a single rotated profile (i.e., in rotated profile view).

Conventional composite blade profile 39 (most clearly shown in the right half of bit 10 in FIG. 3) may generally be divided into three regions conventionally labeled cone region 24, shoulder region 25, and gage region 26. Cone region 24 comprises the radially innermost region of bit 10 and composite blade profile 39 extending generally from bit axis 11 to shoulder region 25. As shown in FIG. 3, in most conventional fixed cutter bits, cone region 24 is generally concave. Adjacent cone region 24 is shoulder (or the upturned curve) region 25. In most conventional fixed cutter bits, shoulder region 25 is generally convex. Moving radially outward, adjacent shoulder region 25 is the gage region 26 which extends parallel to bit axis 11 at the outer radial periphery of composite blade profile 39. Thus, composite blade profile 39 of conventional bit 10 includes one concave region—cone region 24, and one convex region—shoulder region 25.

The axially lowermost point of convex shoulder region 25 and composite blade profile 39 defines a blade profile nose 27. At blade profile nose 27, the slope of a tangent line 27*a* to convex shoulder region 25 and composite blade profile 39 is zero. Thus, as used herein, the term "blade profile nose" refers to the point along a convex region of a composite blade profile of a bit in rotated profile view at which the slope of a tangent to the composite blade profile is zero. For most conventional fixed cutter bits (e.g., bit 10), the composite blade profile includes only one convex shoulder region (e.g., convex shoulder region 25), and only one blade profile nose (e.g., nose 27). As shown in FIGS. 1-3, cutting elements 40 are arranged in rows along blades 31-36 and are positioned along the bit face 20 in the regions previously described as cone region 24, shoulder region 25 and gage region 26 of composite blade profile 39. In particular, cutting elements 40 are mounted on blades 31-36 in predetermined radially-spaced positions relative to the central axis 11 of the bit 10.

Without regard to the type of bit, the cost of drilling a borehole is proportional to the length of time it takes to drill the borehole to the desired depth and location. The drilling time, in turn, is greatly affected by the number of times the drill bit must be changed in order to reach the targeted formation. This is the case because each time the bit is changed, the entire drill string, which may be miles long, must be retrieved from the borehole section by section. Once the drill string has been retrieved and the new bit installed, the bit must be lowered to the bottom of the borehole on the drill string, which again must be constructed section by section. This process, known as a "trip" of the drill string, requires considerable time, effort, and expense. Accordingly, it is always desirable to employ drill bits that will drill faster and longer and that are usable over a wider range of differing formation hardnesses.

The length of time that a drill bit may be employed before it must be changed depends upon its rate of penetration ("ROP"), as well as its durability or ability to maintain a high or acceptable ROP. Additionally, a desirable characteristic of the bit is that it be "stable" and resist vibration, the most severe type or mode of which is "whirl," which is a term used to describe the phenomenon where a drill bit rotates at the bottom of the borehole about a rotational axis that is offset from the geometric center of the drill bit. Such whirling subjects the cutting elements on the bit to increased loading, which causes premature wearing or destruction of the cutting elements and a loss of penetration rate. Thus, preventing bit vibration and maintaining stability of PDC bits has long been a desirable goal, but one which has not always been achieved. Bit vibration typically may occur in any type of formation, but is most detrimental in the harder formations.

In recent years, the PDC bit has become an industry standard for cutting formations of soft and medium hardnesses. However, as PDC bits are being developed for use in harder formations, bit stability is becoming an increasing challenge. As previously described, excessive bit vibration during drilling tends to dull the bit and/or may damage the bit to an extent that a premature trip of the drill string becomes necessary.

There have been a number of alternative designs proposed for PDC cutting structures that were meant to provide a PDC bit capable of drilling through a variety of formation hardnesses at effective ROPs and with acceptable bit life or durability. Unfortunately, may of the bit designs aimed at minimizing vibration require that drilling be conducted with an increased weight-on-bit (WOB) as compared to bits of earlier designs. For example, some bits have been designed with cutters mounted at less aggressive backrake angles such that they require increased WOB in order to penetrate the formation material to the desired extent. Drilling with an increased or heavy WOB has serious consequences and is generally avoided if possible. Increasing the WOB is accomplished by adding additional heavy drill collars to the drill string. This additional weight increases the stress and strain on all drill string components, causes stabilizers to wear more and to work less efficiently and increases the hydraulic drop in the drill string, requiring the use of higher capacity (and typically higher cost) pumps for circulating the drilling fluid. Compounding the problem still further, the increased WOB causes the bit to wear and become dull much more quickly than would otherwise occur. In order to postpone tripping the drill string, it is common practice to add further WOB and to continue drilling with the partially worn and dull bit. The relationship between bit wear and WIB is not linear, but is an exponential one, such that upon exceeding a particular WOB for a given bit, a very small increase in WOB will cause a tremendous increase in bit wear. Thus, adding more WOB so as to drill with a partially worn bit further escalates the wear on the bit and other drill string components.

Accordingly, there remains a continuing need for fixed cutter drill bits capable of drilling effectively at economical ROPs and ideally to drill in formations having a hardness greater than in which conventional PDC bits can be employed. More specifically, there is a continuing need for a PDC bit that can drill in soft, medium, medium hard, and even in some hard formations while maintaining an aggressive cutting element profile so as to maintain acceptable ROPs for acceptable lengths of time and thereby lower the drilling costs presently experienced in the industry.

SUMMARY OF INVENTION

In one aspect, embodiments disclosed herein relate to a drill bit for drilling a borehole in earth formations that includes a bit body having a bit axis and a bit face; a plurality of blades extending radially along the bit face; and a plurality of cutting elements disposed on the plurality of blades, the plurality of cutting elements comprising: at least one cutter comprising a substrate and a diamond table having a substantially planar cutting face; and at least two conical cutting elements comprising a substrate and a diamond layer having a conical cutting end, wherein in a rotated view of the plurality of cutting elements into a single plane, the at least one cutter is located a radial position from the bit axis that is intermediate the radial positions of the at least two conical cutting elements.

In another aspect, embodiments disclosed herein relate to a downhole cutting tool that includes a tool body; a plurality of blades extending azimuthally from the tool body; a plurality of cutting elements disposed on the plurality of blades, the plurality of cutting elements comprising: at least one conical cutting element comprising a substrate and a diamond layer having a conical cutting end, wherein the at least one conical cutting element comprises an axis of the conical cutting end that is not coaxial with an axis of the substrate.

In yet another aspect, embodiments disclosed herein relate to a downhole cutting tool that includes a tool body; a plurality of blades extending azimuthally from the tool body; a plurality of cutting elements disposed on the plurality of blades, the plurality of cutting elements comprising: at least one conical cutting element comprising a substrate and a diamond layer having a conical cutting end, wherein the at least one conical cutting element comprises a beveled surface adjacent the apex of the conical cutting end.

In yet another aspect, embodiments disclosed herein relate to a downhole cutting tool that includes a tool body; a plurality of blades extending azimuthally from the tool body; a plurality of cutting elements disposed on the plurality of blades, the plurality of cutting elements comprising: at least one conical cutting element comprising a substrate and a diamond layer having a conical cutting end, wherein the at least one conical cutting element comprises an asymmetrical diamond layer.

In yet another aspect, embodiments disclosed herein relate to a downhole cutting tool that includes a tool body; a plurality of blades extending azimuthally from the tool body; a plurality of cutting elements disposed on the plurality of blades, the plurality of cutting elements comprising: at least one conical cutting element comprising a substrate and a diamond layer having a conical cutting end, and at least one diamond impregnated insert inserted into a hole in at least one blade.

In yet another aspect, a downhole cutting tool includes a tool body; a plurality of blades extending azimuthally from the tool body; and a plurality of cutting elements disposed on the plurality of blades, the plurality of cutting elements comprising: at least two cutters comprising a substrate and a diamond table having a substantially planar cutting face; and at least one conical cutting elements comprising a substrate and a diamond layer having a conical cutting end, wherein in a rotated view of the plurality of cutting elements into a single plane, the at least one conical cutting element is located at a radial position from the bit axis that is intermediate the radial positions of the at least two cutters.

In yet another aspect, a downhole cutting tool includes a tool body; a plurality of blades extending azimuthally from the tool body; and a plurality of cutting elements disposed on the plurality of blades, the plurality of cutting elements comprising: at least two cutter comprising a substrate and a diamond table having a substantially planar cutting face; and at least one conical cutting elements comprising a substrate and a diamond layer having a conical cutting end, wherein on a single blade, a conical cutting element is disposed at a radial intermediate position between two cutters, wherein the conical cutting element trails the two cutters.

Other aspects and advantages of the invention will be apparent from the following description and the appended claims.

DETAILED DESCRIPTION

In one aspect, embodiments disclosed herein relate to fixed cutting drill bits containing hybrid cutting structures. In particular, embodiments disclosed herein relate to drill bits containing two or more types of cutting elements, each type having a different mode of cutting action against a formation. Other embodiments disclosed herein relate to fixed cutter drill bits containing conical cutting elements, including the placement of such cutting elements on a bit and variations on the cutting elements that may be used to optimize drilling.

Figure 1:
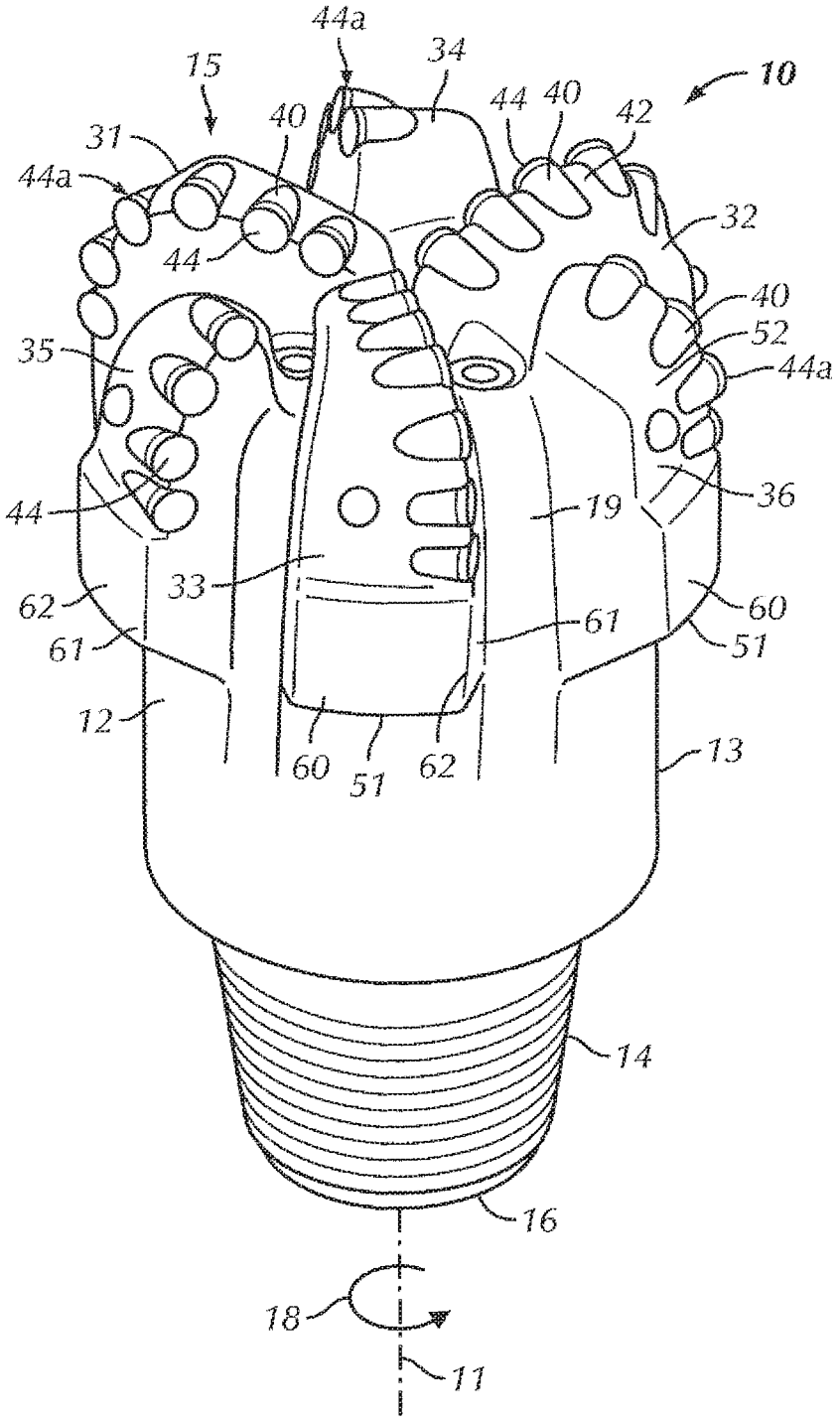
FIG. 1 (Prior Art)
FIG. 1 shows a prior art drill bit.
Figure 2:
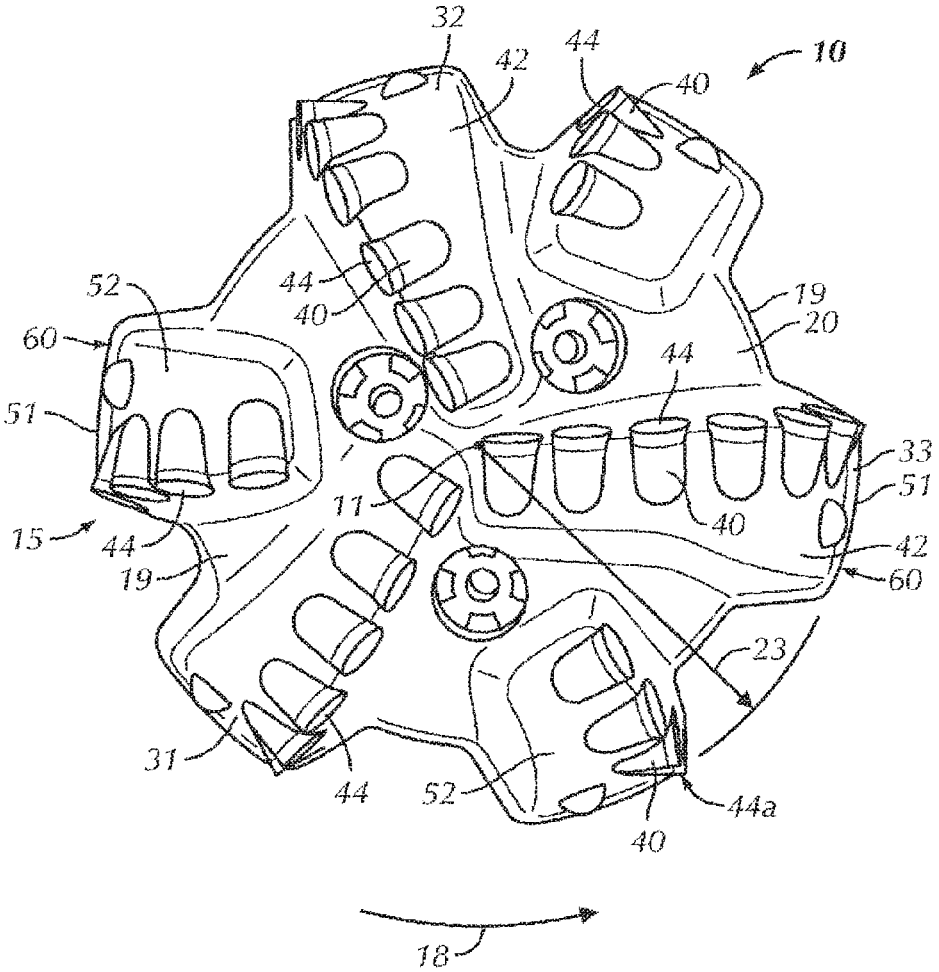
FIG. 2 (Prior Art)
FIG. 2 shows a top view of a prior art drill bit.
Figure 3:
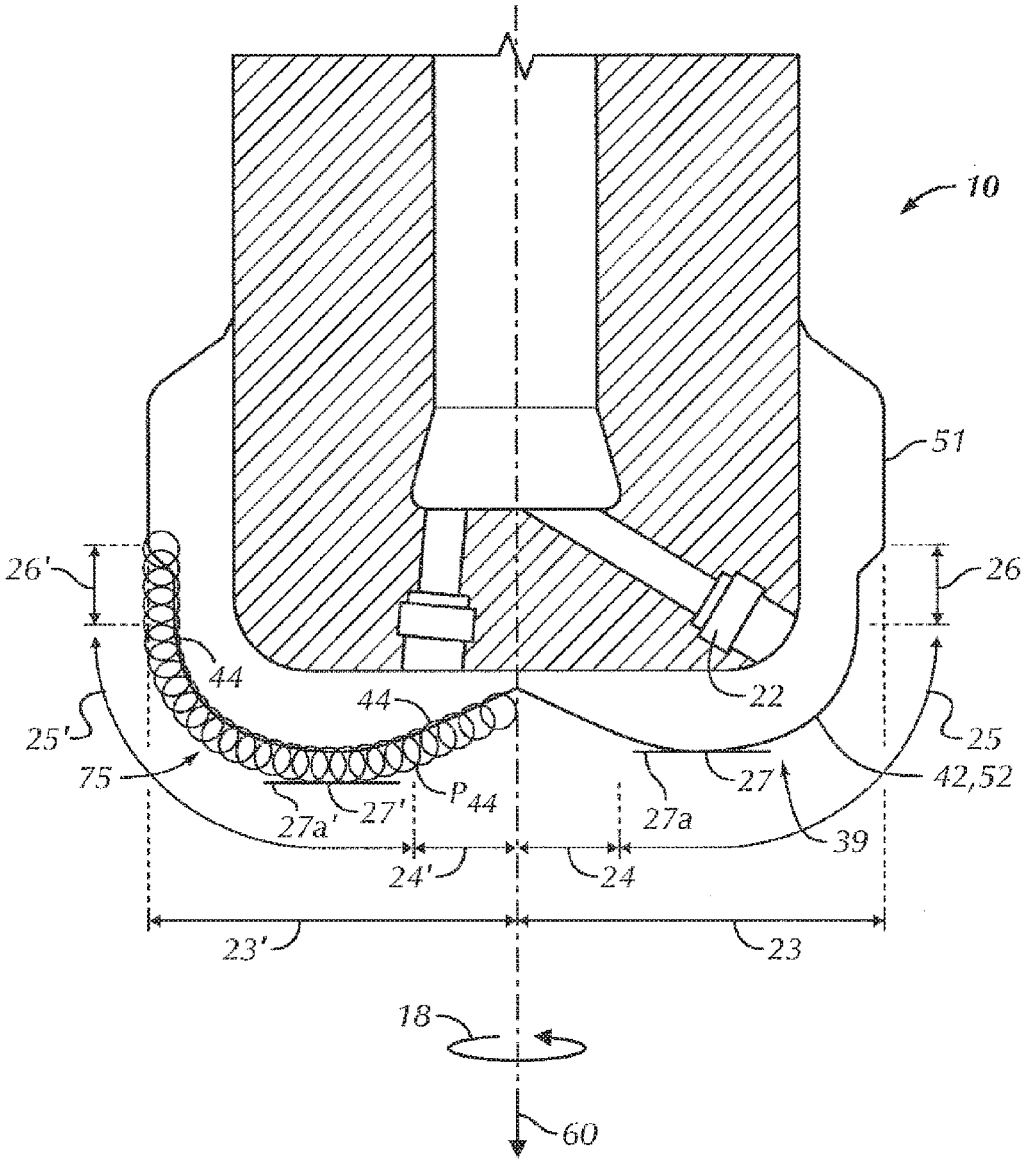
FIG. 3 (Prior Art)
FIG. 3 shows a cross-sectional view of a prior art drill bit.
Figure 4:
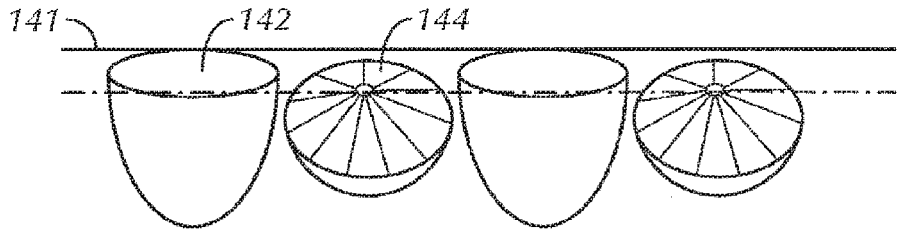
FIG. 4 shows cutting elements according to one embodiment of the present disclosure.
Figure 5:
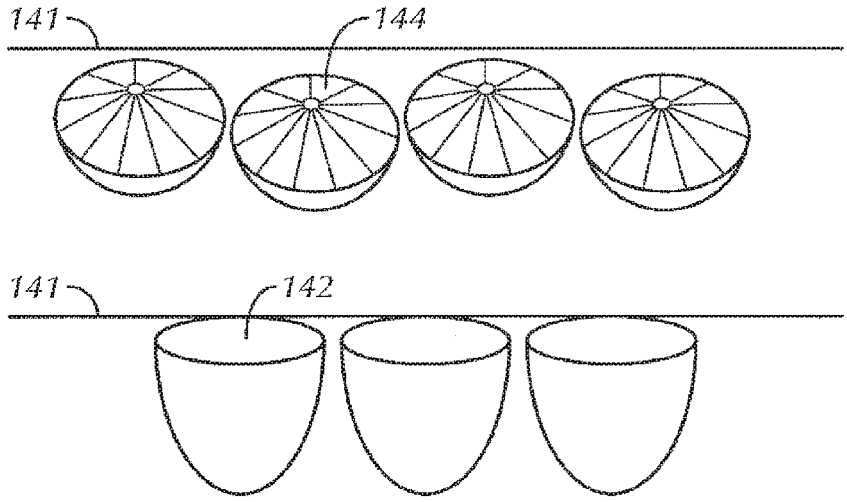
FIG. 5 shows cutting elements according to one embodiment of the present disclosure.

Referring to FIGS. 4 and 5, representative blades having cutting elements thereon for a drill bit (or reamer) formed in accordance with one embodiment of the present disclosure are shown. As shown in FIG. 4, the blade 140 includes a plurality of cutters 142 conventionally referred to as cutters or PDC cutters as well as a plurality of conical cutting elements 144. As used herein, the term "conical cutting elements" refers to cutting elements having a generally conical cutting end (including either right cones or oblique cones) that terminate in an rounded apex. Unlike geometric cones that terminate at an a sharp point apex, the conical cutting elements of the present disclosure possess an apex having curvature between the side surfaces and the apex. The conical cutting elements 144 stand in contrast to the cutters 142 that possess a planar cutting face. For ease in distinguishing between the two types of cutting elements, the term "cutting elements" will generically refer to any type of cutting element, while "cutter" will refer those cutting elements with a planar cutting face, as described above in reference to FIGS. 1 and 2, and "conical cutting element" will refer to those cutting elements having a generally conical cutting end.

Figure 6:
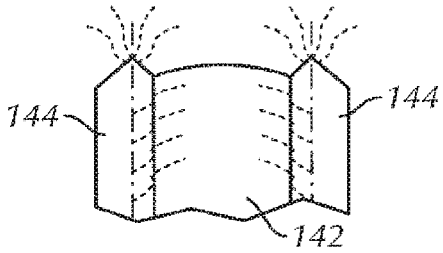
FIG. 6 shows cutting elements according to one embodiment of the present disclosure.
Figure 7:
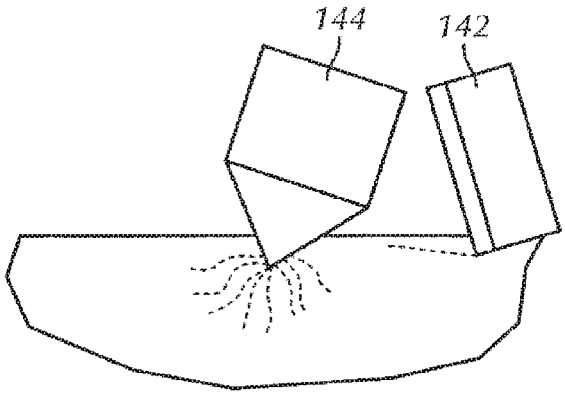
FIG. 7 shows cutting elements according to one embodiment of the present disclosure.
Figure 8:
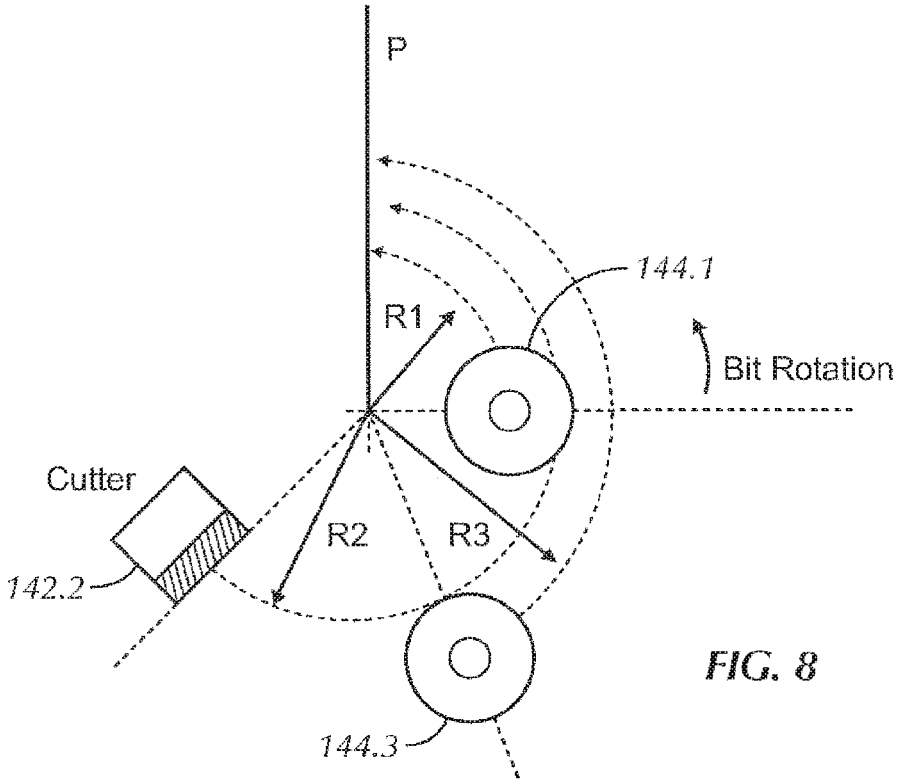
FIG. 8 shows rotation of cutting elements according to one embodiment of the present disclosure.
Figure 9:
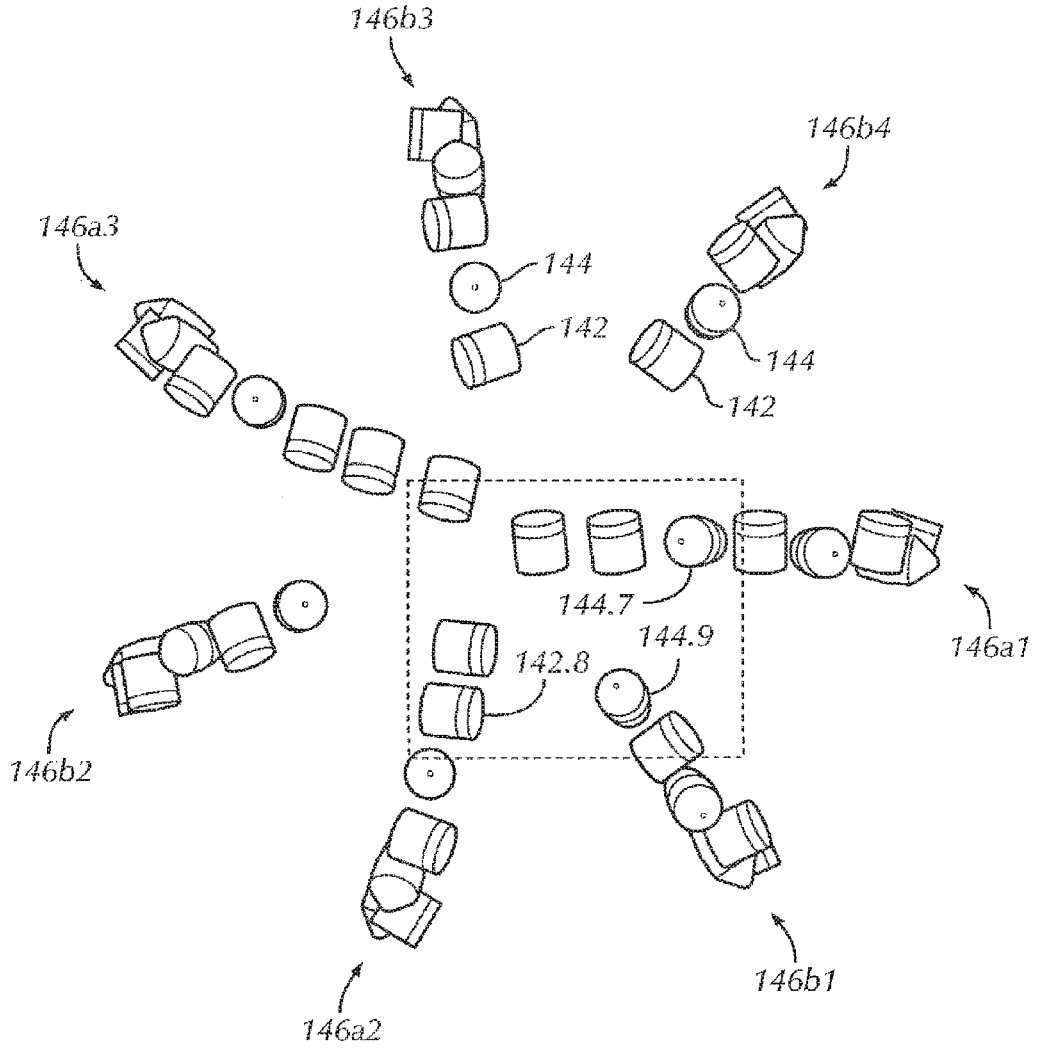
FIG. 9 shows a cutting element layout according to one embodiment of the present disclosure.

Referring to FIGS. 6-8, The present inventors have found that the use of conventional, planar cutters 142 in combination with conical cutting elements 144 may allow for a single bit to possess two types of cutting action (represented by dashed lines): cutting by compressive fracture or gouging of the formation by conical cutting elements 142 in addition to cutting by shearing the formation by cutters 142, as shown in the schematics in FIGS. 8 and 9. As the bit rotates, cutter 142 passes through formation pre-fractured by conical cutting element 144 to trim the kerf created by conical cutting elements 144. Specifically, as detailed in FIG. 8, a first conical cutting element 144.1 at a radial position R1 from the bit centerline is the first cutting element to rotate through reference plane P, as the bit rotates. Conical cutting element 144.3 at a radial position R3 from the bit centerline is the second cutting element to rotate through reference plane P. Cutting element 142.2 at radial position R2 from the bit centerline is the third cutting element to rotate through reference plane P, where R2 is a radial distance intermediate the radial distances of R1 and R3 from the bit centerline.

The embodiment shown in FIG. 4 includes cutters 142 and conical cutting elements 144 on a single blade, whereas the embodiment shown in FIG. 5 includes cutters on one blade, and conical cutting elements 144 on a second blade. Specifically, the cutters 142 are located on a blade 141 that trails the blade on which conical cutting elements 144 are located.

Figure 9A:
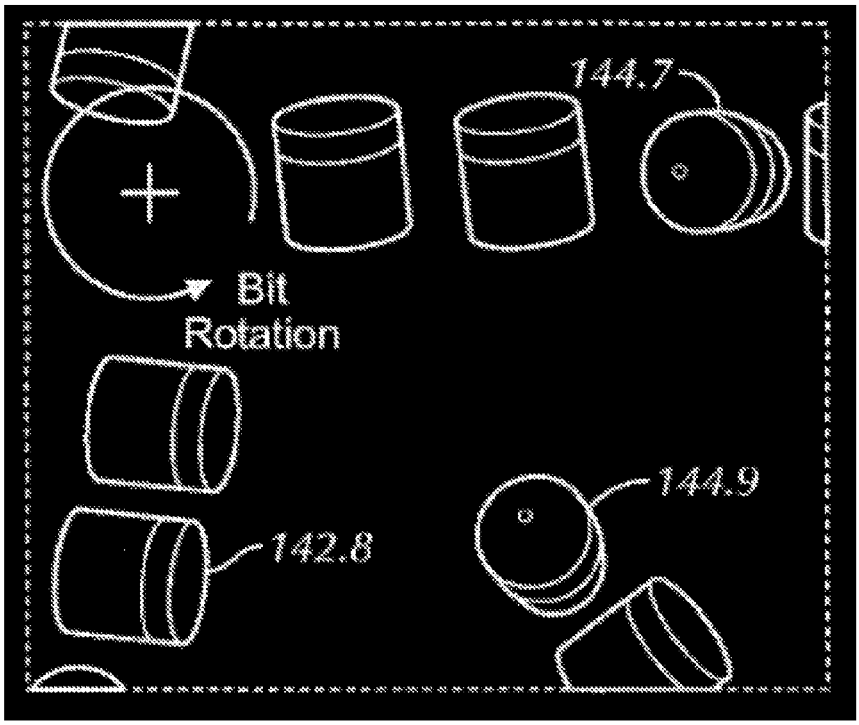
FIG. 9A shows a close-up view of the cutting element layout of FIG. 9.

Referring to FIGS. 9 and 9A, a cutting structure layout for a particular embodiment of drill bit is shown. The cutting structure layout 140 detailed in FIG. 8 shows cutters 142 and conical cutting elements 144 as they would be placed on blades, without showing the blades and other bit body components for the sake of simplicity. However, one of ordinary skill in the art would appreciate from the layout shown in FIG. 9, that the bit on which cutters 142 and conical cutting elements 144 are disposed includes seven blades. Specifically, cutters 142 and conical cutting elements 144 are disposed in rows 146 along seven blades, three primary rows 146*a*1, 146*a*2, and 146*a*3 (on primary blades) and four secondary rows 146*b*1, 146*b*2, 146*b*3, and 146*b*4 (on secondary blades), as those terms are used in FIGS. 1 and 2. In the embodiment shown in FIG. 9, each primary row 146*a*1, 146*a*2, 146*a*3 and each secondary row 146*b*1, 146*b*2, 146*b*3, 146*b*4 includes at least one cutter 142 and at least one conical cutting element 144. However, the present invention is not so limited. Rather, depending on the desired cutting profile, different arrangements of cutters 142 and conical cutting elements 144 may be used.

Two conventional setting or cutter distribution patterns with respect to PDC cutters are: the "single set" method and the "plural set" method. In the "single set" method, each PDC cutter that is positioned across the face of the bit is given a unique radial position measured from the center axis of the bit outwards towards the gage. With respect to a plural set pattern (also known as "redundant cutter" or "tracking cutter" pattern), PDC cutters as deployed in sets containing two or more cutters each, wherein the cutters of a given set are positioned at a same radial distance from the bit axis.

Figure 10A:
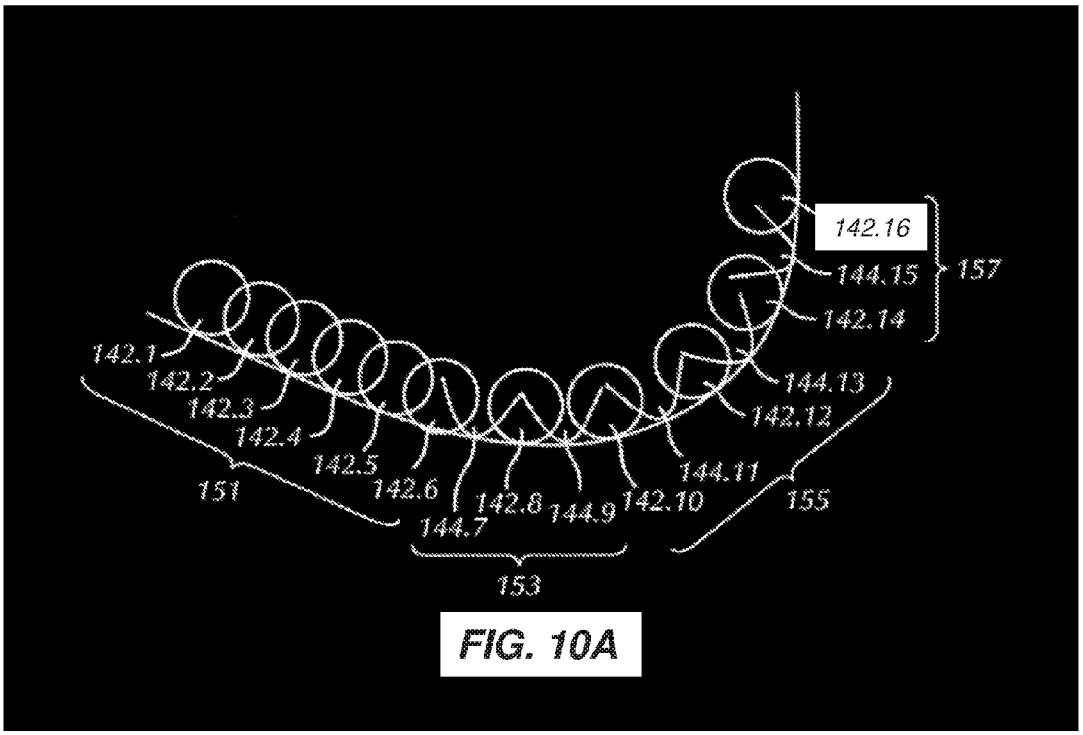
FIG. 10A shows a cutting element distribution plan according to one embodiment of the present disclosure.
Figure 10B:
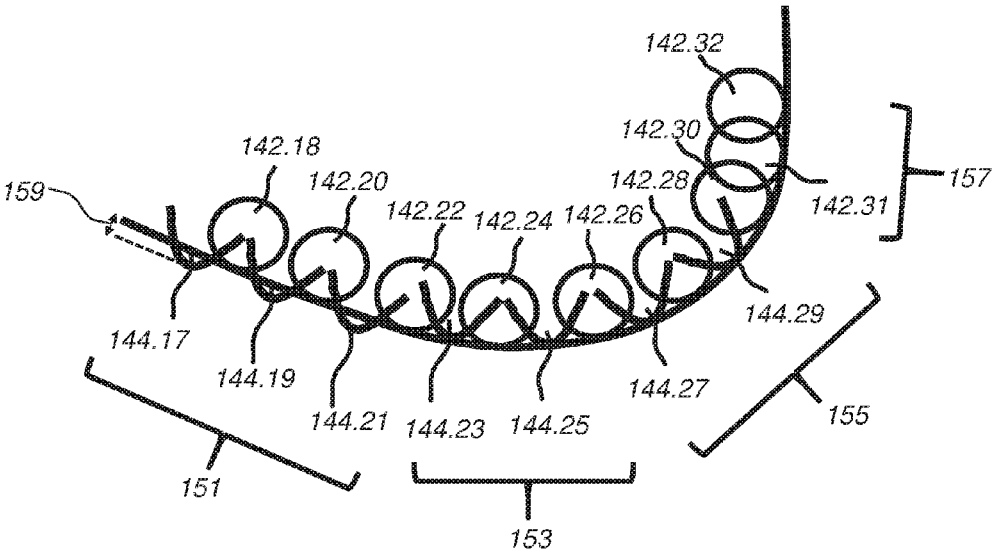
FIG. 10B shows a cutting element distribution plan according to one embodiment of the present disclosure.

Referring to FIGS. 10A-B, each illustrate a cutter distribution plan in accordance with one embodiment of the present disclosure, showing all cutting elements on a bit rotated into a single plane. As shown in FIGS. 10A-10B, the cutting elements include both conventional cutters 142 having planar cutting face as well as conical cutting elements 144. The cutters 142 and conical cutting elements 144 shown in FIGS. 10A-B are also identified by their radial position from the bit axis in the form of the numeral that follows the "142" or "144" label. In accordance with some embodiments of the present disclosure, a cutter 142 may cut between two radially adjacent conical cutting elements 144. Specifically, as shown in FIG. 10A, cutter 142.8 is located in a radially intermediate position between conical cutting elements 144.7 and 144.9. Similarly, cutter 142.12 is located in a radially intermediate position between conical cutting elements 144.11 and 144.13. Further, the present invention is not limited to bits in which this alternating pattern exists between each and every cutting element.

In FIG. 10A, it is clear that not every cutter possess a conical cutting element at radially adjacent positions. Rather, as shown in FIG. 10A, the conical cutting elements are disposed in the nose 153, shoulder 155, and gage 157 regions of the cutting profile. However, in other embodiments such as that shown in FIG. 10B, the conical cutting elements 144 may also be located in the cone region 151 and/or may be excluded from the gage region 157. Further, as illustrated in FIG. 10B, it is also within the scope of the present disclosure that the different cutting profile regions may have conical cutting elements 144 having different exposure heights (as compared to the cutters 142) between the different regions. Such difference may be a gradual or stepped transition. In FIG. 10B, the difference between the exposure height of the conical cutting elements 144 and cutters 142 within the cone region is height 159, while within the shoulder region 153, conical cutting elements 144 have the same exposure height as cutters 142.

Referring back to FIGS. 9 and 9A, radially adjacent (when viewed into a rotated plane) elements 144.7, 142.8, and 144.9 are located on multiple blades. Specifically, conical cutting elements 144.7 and 144.9 create gouges in the formation, which is followed by cutter 142.8. Thus, cutter 142.8 is on a trailing blade 146*a*2 as compared to each of conical cutting elements 144.7 and 144.9. A trailing blade is a blade that when rotated about an axis, rotates through a reference plane subsequent to a leading blade. In the embodiment shown in FIGS. 9 and 9A, conical cutting elements 144.7 and 144.9 are on two separate blades (i.e., blades 146*a*1 and 146*b*1); however, in other embodiments, the two conical cutting elements 144 residing on radially adjacent positions to cutter 142 may be on the same blade.

Figure 11A:
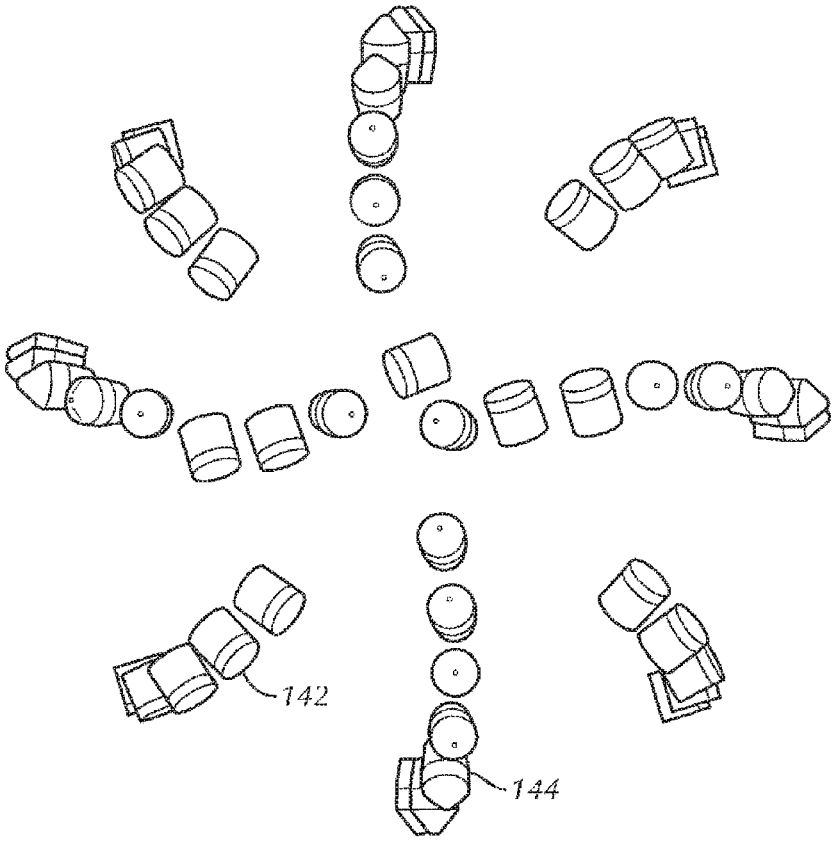
FIG. 11A shows a cutting element layout according to one embodiment of the present disclosure.
Figure 11B:
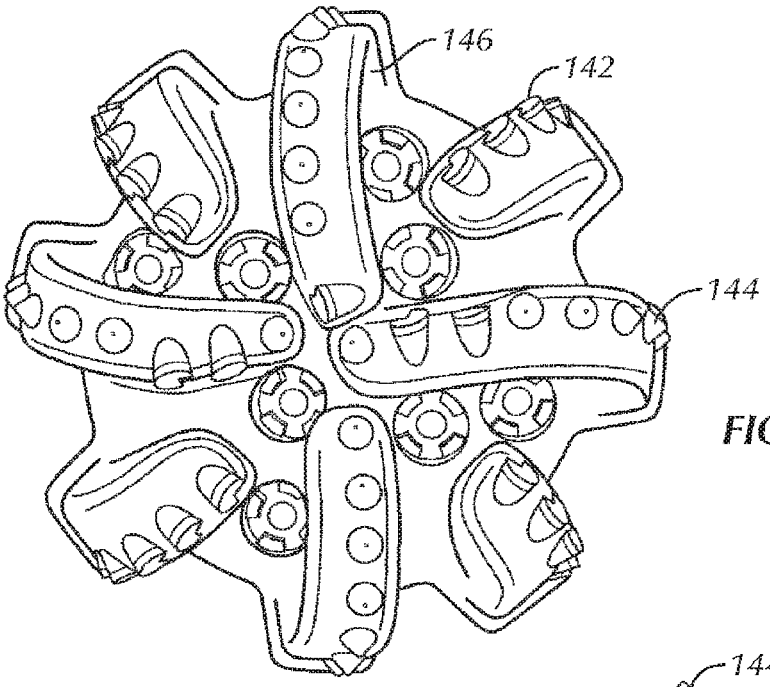
FIG. 11B shows a top view of a drill bit having the cutting element layout of FIG. 11A.
Figure 11C:
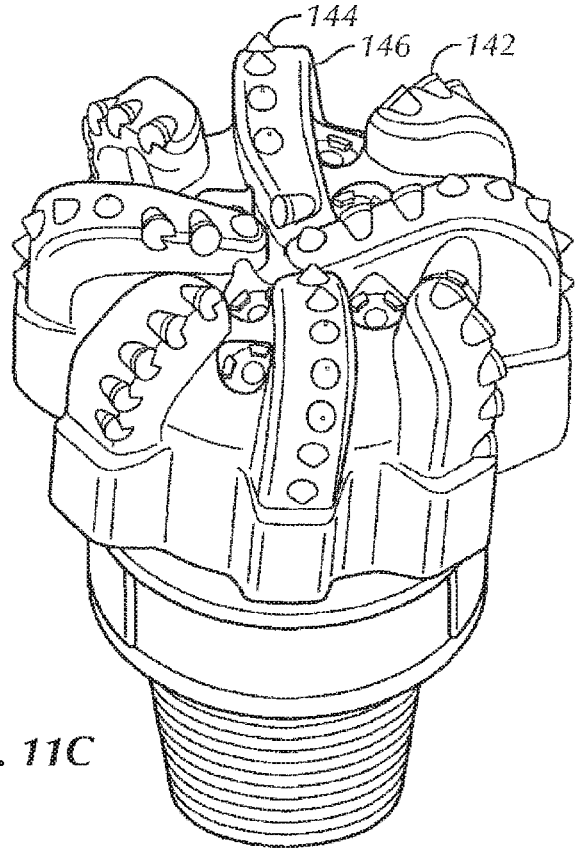
FIG. 11C shows a top view of a drill bit having the cutting element layout of FIG. 11A.

Referring to FIGS. 11A-C a cutting structure layout for a particular embodiment of drill bit (shown in FIGS. 11B-C) is shown in FIG. 11A. For example, as shown in FIGS. 11A-C, the radial positions of the cutting elements is such that two blades 146 of cutting elements consist entirely of conical cutting elements 144, four rows 146 consist entirely of cutters 142, and two rows 146 include a mixture of cutters 142 and conical cutting elements 144. Unlike the embodiment shown in FIG. 9, the embodiment in FIGS. 11A-C include an alternation between conical cutting elements 144 and cutters 142 for each and every position. Thus, in such a case, the conical cutting elements 144 would be located at each and every oddly numbered radial position, and cutters 142 would be located at each and every evenly numbered radial position. Further, depending on the particular radial positions of the cutting elements, a pair of conical cutting elements 142 leaving a kerf through which a cutter 142 passes may be on the same blade or may be on different blades.

Figure 12:
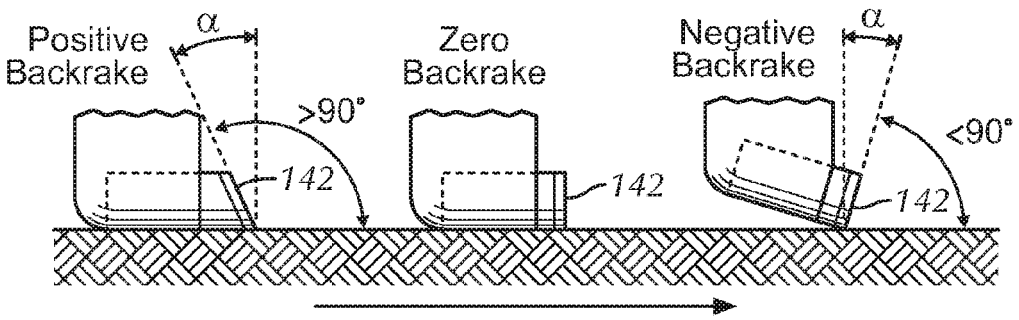
FIG. 12 PRIOR ART
FIG. 12 shows backrake angles for conventional cutting elements.

Generally, when positioning cutting elements (specifically cutters) on a blade of a bit or reamer, the cutters may be inserted into cutter pockets (or holes in the case of conical cutting elements) to change the angle at which the cutter strikes the formation. Specifically, the back rake (i.e., a vertical orientation) and the side rake (i.e., a lateral orientation) of a cutter may be adjusted. Generally, back rake is defined as the angle $\alpha$ formed between the cutting face of the cutter 142 and a line that is normal to the formation material being cut. As shown in FIG. 12, with a conventional cutter 142 having zero backrake, the cutting face 44 is substantially perpendicular or normal to the formation material. A cutter 142 having negative backrake angle $\alpha$ has a cutting face 44 that engages the formation material at an angle that is less than 90° as measured from the formation material. Similarly, a cutter 142 having a positive backrake angle $\alpha$ has a cutting face 44 that engages the formation material at an angle that is greater than 90° when measured from the formation material. Side rake is defined as the angle between the cutting face and the radial plane of the bit (x-z plane). When viewed along the z-axis, a negative side rake results from counterclockwise rotation of the cutter, and a positive side rake, from clockwise rotation. In a particular embodiment, the backrake of the conventional cutters may range from −5 to −45, and the side rake from 0-30.

Figure 13:
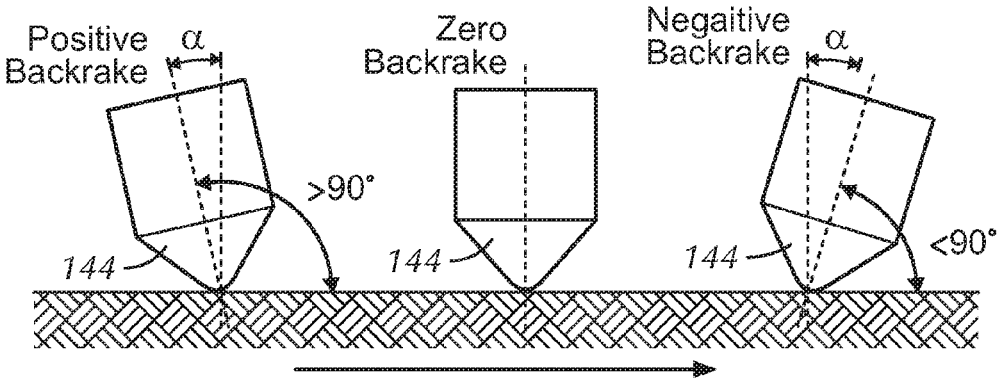
FIG. 13 shows backrake angles for conical cutting elements according to the present disclosure.

However, conical cutting elements do not have a cutting face and thus the orientation of conical cutting elements must be defined differently. When considering the orientation of conical cutting elements, in addition to the vertical or lateral orientation of the cutting element body, the conical geometry of the cutting end also affects how and the angle at which the conical cutting element strikes the formation. Specifically, in addition to the backrake affecting the aggressiveness of the conical cutting element-formation interaction, the cutting end geometry (specifically, the apex angle and radius of curvature) greatly affect the aggressiveness that a conical cutting element attacks the formation. In the context of a conical cutting element, as shown in FIG. 12, backrake is defined as the angle α formed between the axis of the conical cutting element 144 (specifically, the axis of the conical cutting end) and a line that is normal to the formation material being cut. As shown in FIG. 13, with a conical cutting element 144 having zero backrake, the axis of the conical cutting element 144 is substantially perpendicular or normal to the formation material. A conical cutting element 144 having negative backrake angle α has an axis that engages the formation material at an angle that is less than 90° as measured from the formation material. Similarly, a conical cutting element 144 having a positive backrake angle α has an axis that engages the formation material at an angle that is greater than 90° when measured from the formation material. In a particular embodiment, the backrake angle of the conical cutting elements may be zero, or in another embodiment may be negative. In a particular embodiment, the backrake of the conical cutting elements may range from −10 to 10, from zero to 10 in a particular embodiment, and from −5 to 5 in an alternate embodiment. Additionally, the side rake of the conical cutting elements may range from about −10 to 10 in various embodiments.

Figure 14:
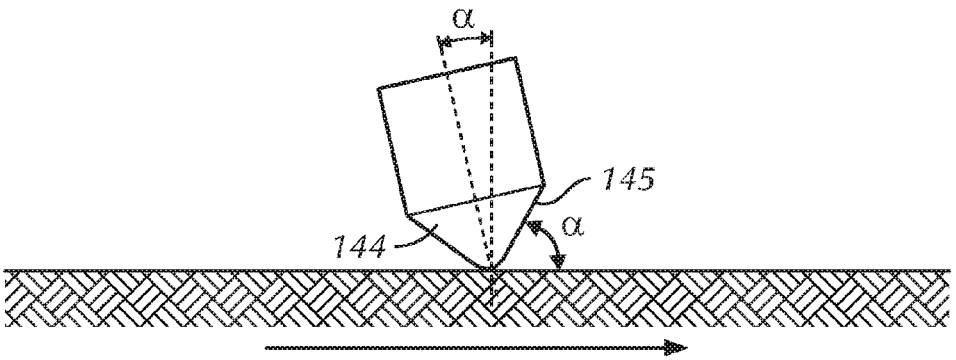
FIG. 14 shows strike angles for conical cutting elements of the present disclosure.

In addition to the orientation of the axis with respect to the formation, the aggressiveness of the conical cutting elements may also be dependent on the apex angle or specifically, the angle between the formation and the leading portion of the conical cutting element. Because of the conical shape of the conical cutting elements, there does not exist a leading edge; however, the leading line of a conical cutting surface may be determined to be the first most points of the conical cutting element at each axial point along the conical cutting end surface as the bit rotates. Said in another way, a cross-section may be taken of a conical cutting element along a plane in the direction of the rotation of the bit, as shown in FIG. 14. The leading line 145 of the conical cutting element 144 in such plane may be considered in relation to the fog nation. The strike angle of a conical cutting element 144 is defined to be the angle α formed between the leading line 145 of the conical cutting element 144 and the formation being cut. The strike angle will vary depending on the backrake and the cone angle, and thus, the strike angle of the conical cutting element may be calculated to be the backrake angle less one-half of the cone angle(i.e., α=BR−(0.5*cone angle)).

Referring back to FIG. 7, it is also within the scope of the present disclosure that cutters 142 and conical cutting elements 144 may be set at a different exposure height. Specifically, in a particular embodiment, at least one cutter 142 may be set with a greater exposure height than at least one conical cutting element 144, which in even more particular embodiment, may be a radially adjacent cutter 142. Alternatively, the cuttings elements may be set at the same exposure height, or at least one conical cutting element 144 may be set with a greater exposure height than at least one cutter 142, which in even more particular embodiment, may be a radially adjacent cutter 142. The selection of exposure height difference may be based, for example, on the type of formation to be drilled. For example, a conical cutting element 144 with a greater exposure height may be preferred when the formation is harder, whereas, cutters 142 with a greater exposure height may be preferred when the formation is softer. Further, the exposure difference may be allow for better drilling in transition between formation types. If a cutter has a greater exposure height (for drilling through a softer formation), it may dull when a different formation type is hit, and the dulling of the cutter may allow for engagement of the conical cutting element.

Further, the use of conical cutting elements 144 with cutters 142 may allow for cutters 142 to have a smaller beveled cutting edge than conventionally suitable for drilling (a bevel large enough to minimize likelihood of chipping). For example, cutters 142 may be honed (~0.001 inch bevel length) or may possess a bevel length of up to about 0.005 inches. However, it is also within the present disclosure that larger bevels (greater than 0.005 inches) may be used.

Figure 20:
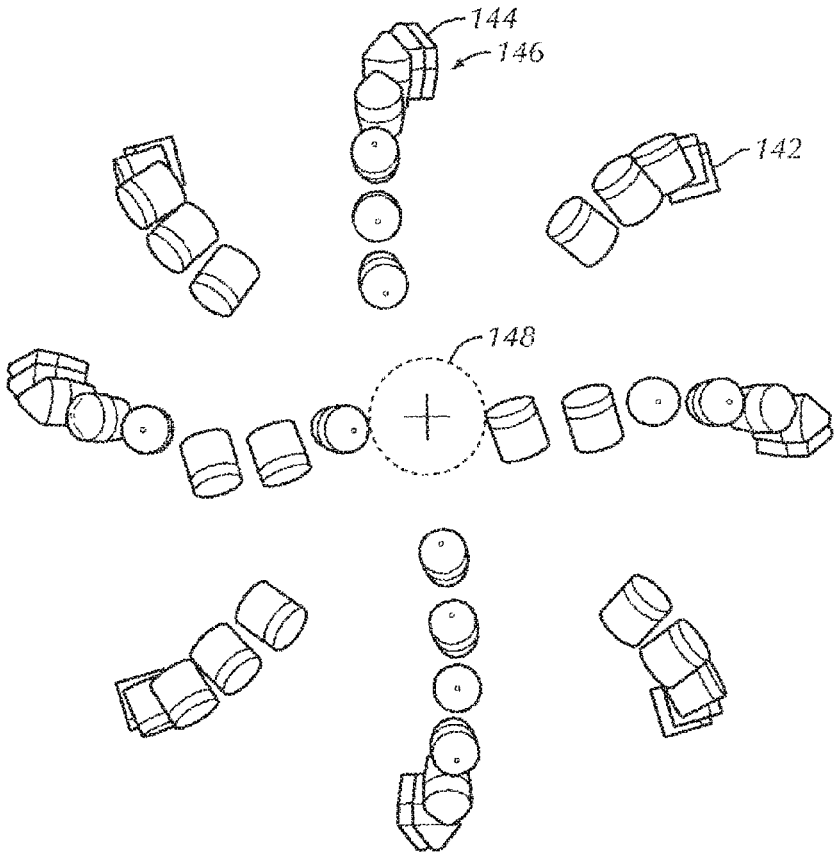
FIG. 20 shows a cutting element layout according to one embodiment of the present disclosure.

While the embodiments shown in FIGS. 9-11 show cutting elements extending substantially near the centerline of the drill bit (and/or blades that intersect the centerline), it is also within the scope of the present disclosure that a center region of the bit may be kept free of cutting structures (and blades). An example cutting element layout of such a drill bit is shown in FIG. 20. Referring to FIG. 20, cutters 142 and conical cutting element 144 are located on blades 146 that do not intersect the centerline of the bit, but rather form a cavity in this center portion 148 of the bit between the blades free of cutting elements. Alternatively, various embodiments of the present disclosure may include a center core cutting element, such as the type described in U.S. Pat. No. 5,655,614, assigned to the present assignee and herein incorporated by reference in its entirety. Such a cutting element may have either a cylindrical shape, similar to cutters 142, or a conical cutting end, similar to conical cutting elements 144.

Some embodiments of the present disclosure may involve the mixed use of cutters and conical cutting elements, where cutters are spaced further apart from one another, and conical cutting elements are placed at positions intermediate between two radially adjacent cutters. The spacing between cutters 142 in embodiments (including those described above) may be considered as the spacing between two adjacent cutters 142 on the same blade, or two radially adjacent cutters 142 when all of the cutting elements are rotated into a single plane view.

Figure 21:
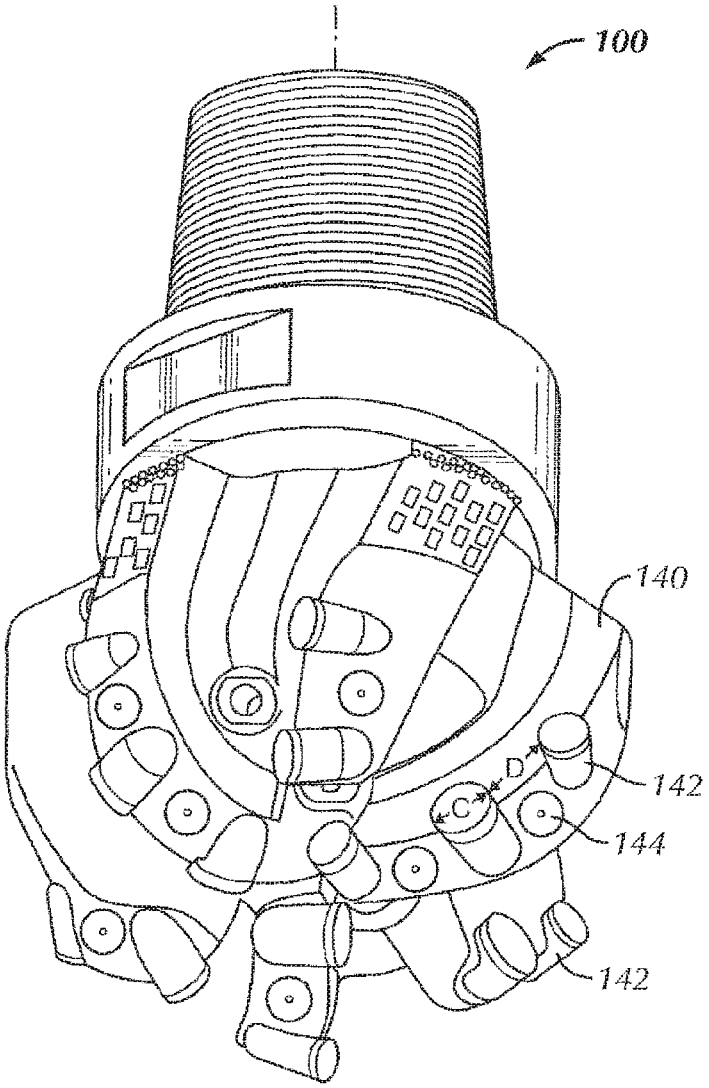
FIG. 21 shows a drill bit according to one embodiment of the present disclosure.

For example, referring to FIG. 21, a drill bit 100 may include a plurality of blades 140 having a plurality of cutters 142 and a plurality of conical cutting elements 144 thereon. As shown, cutters 142 and conical cutting elements 144 are provided in an alternating pattern on each blade 140. With respect to two cutters 142 adjacent one another (with a conical cutting element 144 therebetween at a trailing position) on the same blade, the two adjacent cutters may be spaced a distance D apart from one another, as illustrated in FIG. 21. In one embodiment, D may be equal to or greater than one-quarter the value of cutter diameter C, i.e., $\frac{1}{4}C \leq D$. In other embodiments, the lower limit of D may be any of 0.1C, 0.2C, 0.25C, 0.33C, 0.5C, 0.67C, 0.75C, C, or 1.5C, and the upper limit of D may be any of 0.5C, 0.67C, 0.75C, C, 1.25C, 1.5C, 1.75C, or 2C, where any lower limit may be in combination with any upper limit. Conical cutting elements 144 may be placed on a blade 140 at a radial intermediate position between two cutters (on the same blade or on two or more different blades in a leading or trailing position with respect to the cutters) to protect the blade surface and/or to aid in gouging of the formation.

Figure 22:
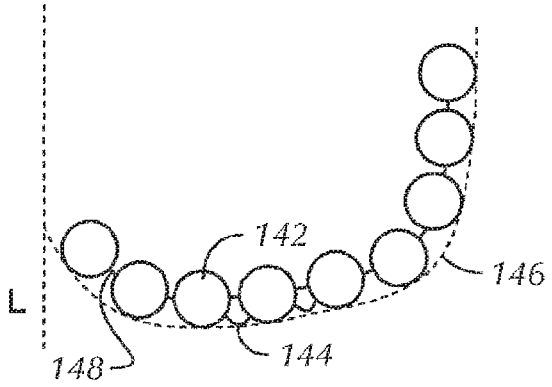
FIG. 22 shows a cutting profile according to one embodiment of the present disclosure.

The selection of the particular spacing between adjacent cutters 142 may be based on the number of blades, for example, and/or the desired extent of overlap between radially adjacent cutters when all cutters are rotated into a rotated profile view. For example, in some embodiments, it may be desirable to have full bottom hole coverage (no gaps in the cutting profile formed from the cutters 142) between all of the cutters 142 on the bit 100, whereas in other embodiments, it may be desirable to have a gap 148 between at least some cutters 142 instead at least partially filled by conical cutting elements 144, as illustrated in FIG. 22. In some embodiments, the width between radially adjacent cutters 142 (when rotated into a single plane) may range from 0.1 inches up to the diameter of the cutter (i.e. C). In other embodiments, the lower limit of the width between cutters 142 (when rotated into a single plane) may be any of 0.1C, 0.2C, 0.4C, 0.5C, 0.6C, or 0.8C, and the upper limit of the width between cutters 142 (when rotated into a single plane) may be any of 0.4C, 0.5C, 0.6C, 0.8C, or C, where any lower limit may be in combination with any upper limit.

Figure 23:
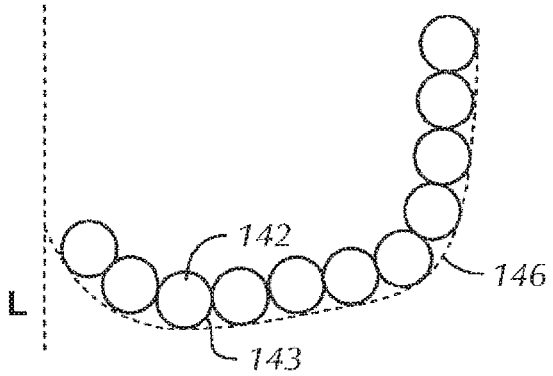
FIG. 23 shows a cutting profile according to one embodiment of the present disclosure.
Figure 24:
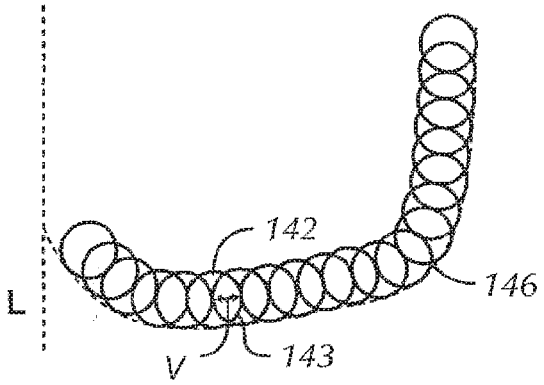
FIG. 24 shows a cutting profile according to one embodiment of the present disclosure.

In other embodiments, the cutting edges 143 of radially adjacent (in a rotated view) cutters 142 may be at least tangent to one another, as illustrated in FIG. 23 which shows another embodiment of cutting profile 146 of cutters 142 when rotated into a single plane view extending outward from a longitudinal axis L of bit (not shown). While not shown, conical cutting elements may be included between any two radially adjacent cutters 142 (in a rotated view), as discussed above. As illustrated in FIG. 24, showing another embodiment of cutting profile 146 of cutters 142 when rotated into a single plane view extending outward from a longitudinal axis L of bit (not shown), the cutting edges 143 of radially adjacent (in a rotated view) cutters 142 may overlap by an extent V. While not shown, conical cutting elements may be included between any two radially adjacent cutters 142 (in a rotated view), as discussed above. Overlap V may be defined as the distance along the cutting face of cutters 142 of overlap that is substantially parallel to the corresponding portion of the cutting profile 146. In one embodiment, the upper limit of overlap V between two radially adjacent (in a rotated view) cutters 142 may be equal to the radius of the cutter (or one-half the cutter diameter C), i.e., $V \leq C/2$. In other embodiments, the upper limit of overlap V may be based on radius (C/2) and the number of blades present on the bit, specifically the radius divided the number of blades, i.e., C/2B, where B is the number of blades. Thus, for a two-bladed bit, the upper limit of overlap V may be C/4, and for a four-bladed bit, the upper limit of overlap V may be C/8. Thus, V may generally range from $0<V \leq C/2$, and in specific embodiments, the lower limit of V may be any of C/10B, C/8B, C/6B, C/4B, C/28, or 0.1C, 0.2C, 0.3C, or 0.4C (for any number of blades), and the upper limit of V may be any of, C/8B, C/6B, C/4B, C/2B, 0.2C, 0.3C, 0.4C, or 0.5C, where any lower limit may be used with any upper limit.

In an example embodiment, cutting faces of cutters may have a greater extension height than the tip of conical cutting elements (i.e., "on-profile" primary cutting elements engage a greater depth of the formation than the backup cutting elements; and the backup cutting elements are "off-profile"). In other embodiments, the conical cutting elements may have a greater extension height than conventional cutters. As used herein, the term "off-profile" may be used to refer to a structure extending from the cutter-supporting surface (e.g., the cutting element, depth-of-cut limiter, etc.) that has an extension height less than the extension height of one or more other cutting elements that define the outermost cutting profile of a given blade. As used herein, the term "extension height" is used to describe the distance a cutting face extends from the cutter-supporting surface of the blade to which it is attached. In some embodiments, a back-up cutting element may be at the same exposure as the primary cutting element, but in other embodiments, the primary cutter may have a greater exposure or extension height above the backup cutter. Such extension heights may range, for example, from 0.005 inches up to C/2 (the radius of a cutter). In other embodiments, the lower limit of the extension height may be any of 0.1C, 0.2C, 0.3C, or 0.4C and the upper limit of the extension height may be any of 0.2C, 0.3C, 0.4C, or 0.5C, where any lower limit may be used with any upper limit. Further extension heights may be used in any of the above embodiments involving the use of both conical cutting elements and cutters.

It is also within the scope of the present disclosure that any of the above embodiments may use non-conical but otherwise non-planar, gouging cutting elements in place of conical cutting elements, that is cutting elements having an apex that may gouge the formation, such as chisel-shaped, dome-shaped, frusto-conical-shaped, or faceted cutting elements, etc.

Further, various embodiments of the present disclosure may also include a diamond impregnated cutting means. Such diamond impregnation may be in the form of impregnation within the blade or in the form of cutting elements formed from diamond impregnated materials. Specifically, in a particular embodiment, diamond impregnated inserts, such as those described in U.S. Pat. No. 6,394,202 and U.S. Patent Publication No. 2006/0081402, frequently referred to in the art as grit hot pressed inserts (GHIs), may be mounted in sockets formed in a blade substantially perpendicular to the surface of the blade and affixed by brazing, adhesive, mechanical means such as interference fit, or the like, similar to use of GHIs in diamond impregnated bits, as discussed in U.S. Pat. No. 6,394,202, or inserts may be laid side by side within the blade. Further, one of ordinary skill in the art would appreciate that any combination of the above discussed cutting elements may be affixed to any of the blades of the present disclosure. In a particular embodiment, at least one preformed diamond impregnated inserts or GHIs may be placed in a backup position to (i.e., behind) at least one conical cutting element. In another particular embodiment, a preformed diamond impregnated insert may be placed at substantially the same radial position in a backup or trailing position to each conical cutting element. In a particular embodiment, a preformed diamond impregnated insert is placed in a backup or trailing position to a conical cutting element at a lower exposure height than the conical cutting element. In a particular embodiment, the diamond impregnated insert is set from about 0.030 to 0.100 inches below the apex of the conical cutting element. Further, the diamond impregnated inserts may take a variety shapes. For example, in various embodiments, the upper surface of the diamond impregnated element may be planar, domed, or conical to engage the formation. In a particular embodiment, either a domed or conical upper surface.

Such embodiments containing diamond impregnated inserts or blades, such impregnated materials may include super abrasive particles dispersed within a continuous matrix material, such as the materials described below in detail. Further, such preformed inserts or blades may be formed from encapsulated particles, as described in U.S. Patent Publication No. 2006/0081402 and U.S. application Ser. Nos. 11/779,083, 11/779,104, and 11/937,969. The super abrasive particles may be selected from synthetic diamond, natural diamond, reclaimed natural or synthetic diamond grit, cubic boron nitride (CBN), thermally stable polycrystalline diamond (TSP), silicon carbide, aluminum oxide, tool steel, boron carbide, or combinations thereof. In various embodiments, certain portions of the blade may be impregnated with particles selected to result in a more abrasive leading portion as compared to trailing portion (or vice versa).

The impregnated particles may be dispersed in a continuous matrix material formed from a matrix powder and binder material (binder powder and/or infiltrating binder alloy). The matrix powder material may include a mixture of a carbide compounds and/or a metal alloy using any technique known to those skilled in the art. For example, matrix powder material may include at least one of macrocrystalline tungsten carbide particles, carburized tungsten carbide particles, cast tungsten carbide particles, and sintered tungsten carbide particles. In other embodiments non-tungsten carbides of vanadium, chromium, titanium, tantalum, niobium, and other carbides of the transition metal group may be used. In yet other embodiments, carbides, oxides, and nitrides of Group IVA, VA, or VIA metals may be used. Typically, a binder phase may be fainted from a powder component and/or an infiltrating component. In some embodiments of the present invention, hard particles may be used in combination with a powder binder such as cobalt, nickel, iron, chromium, copper, molybdenum and their alloys, and combinations thereof. In various other embodiments, an infiltrating binder may include a Cu—Mn–Ni alloy, Ni—Cr—Si—B—Al—C alloy, Ni—Al alloy, and/or Cu—P alloy. In other embodiments, the infiltrating matrix material may include carbides in amounts ranging from 0 to 70% by weight in addition to at least one binder in amount ranging from 30 to 100% by weight thereof to facilitate bonding of matrix material and impregnated materials. Further, even in embodiments in which diamond impregnation is not provided (or is provided in the form of a preformed insert), these matrix materials may also be used to form the blade structures into which or on which the cutting elements of the present disclosure are used.

Figure 15A:
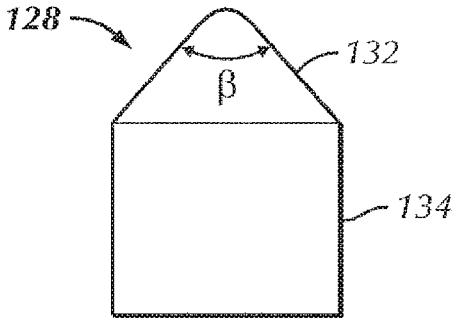
FIG. 15A-C shows various conical cutting elements according to the present disclosure.
Figure 15B:
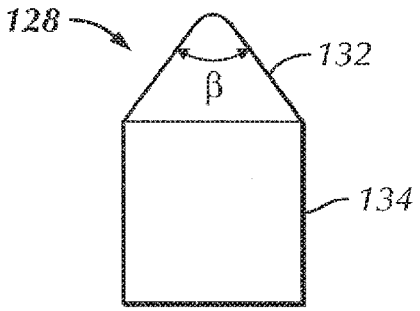
Figure 15C:
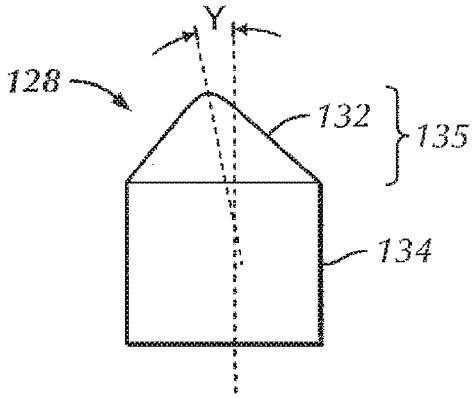

Referring now to FIGS. 15A-C, variations of conical cutting elements that may be in any of the embodiments disclosed herein are shown. The conical cutting elements 128 (variations of which are shown in FIGS. 15A-15C) provided on a drill bit or reamer possess a diamond layer 132 on a substrate 134 (such as a cemented tungsten carbide substrate), where the diamond layer 132 forms a conical diamond working surface. Specifically, the conical geometry may comprise a side wall that tangentially joins the curvature of the apex. Conical cutting elements 128 may be formed in a process similar to that used in forming diamond enhanced inserts (used in roller cone bits) or may brazing of components together. The interface (not shown separately) between diamond layer 132 and substrate 134 may be non-planar or non-uniform, for example, to aid in reducing incidents of delamination of the diamond layer 132 from substrate 134 when in operation and to improve the strength and impact resistance of the element. One skilled in the art would appreciate that the interface may include one or more convex or concave portions, as known in the art of non-planar interfaces. Additionally, one skilled in the art would appreciate that use of some non-planar interfaces may allow for greater thickness in the diamond layer in the tip region of the layer. Further, it may be desirable to create the interface geometry such that the diamond layer is thickest at a critical zone that encompasses the primary contact zone between the diamond enhanced element and the formation. Additional shapes and interfaces that may be used for the diamond enhanced elements of the present disclosure include those described in U.S. Patent Publication No. 2008/0035380, which is herein incorporated by reference in its entirety. Further, the diamond layer 132 may be formed from any polycrystalline superabrasive material, including, for example, polycrystalline diamond, polycrystalline cubic boron nitride, thermally stable polycrystalline diamond (formed either by treatment of polycrystalline diamond formed from a metal such as cobalt or polycrystalline diamond formed with a metal having a lower coefficient of thermal expansion than cobalt).

As mentioned above, the apex of the conical cutting element may have curvature, including a radius of curvature. In this embodiment, the radius of curvature may range from about 0.050 to 0.125. In some embodiments, the curvature may comprise a variable radius of curvature, a portion of a parabola, a portion of a hyperbola, a portion of a catenary, or a parametric spline. Further, referring to FIGS. 15A-B, the cone angle $\beta$ of the conical end may vary, and be selected based on the particular formation to be drilled. In a particular embodiment, the cone angle $\beta$ may range from about 75 to 90 degrees.

Figure 17:
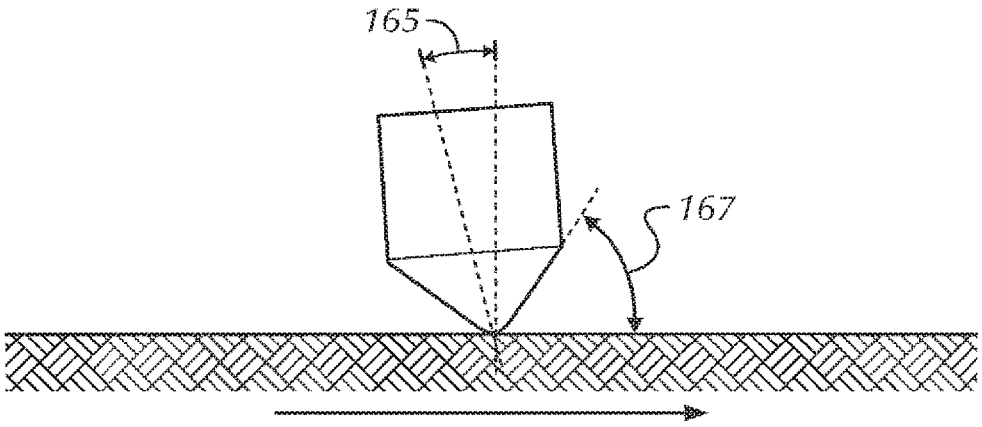
FIG. 17 shows an embodiment of a conical cutting element according to the present disclosure.
Figure 18:
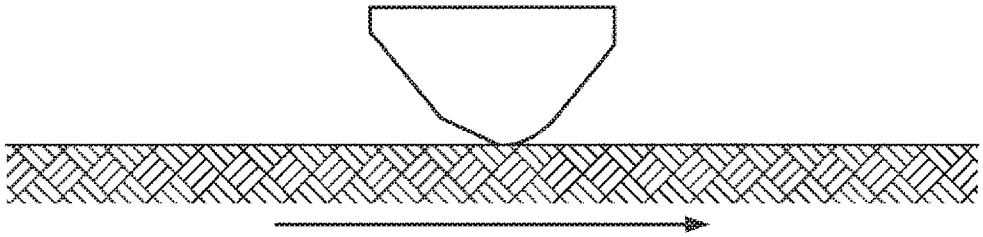
FIG. 18 shows an embodiment of a conical cutting element according to the present disclosure.

Referring now to FIG. 15C, an asymmetrical or oblique conical cutting element is shown. As shown in FIG. 15C, the cutting conical cutting end portion 135 of the conical cutting element 128 has an axis that is not coaxial with the axis of the substrate 134. In a particular embodiment, at least one asymmetrical conical cutting element may be used on any of the described drill bits or reamers. Selection of an asymmetrical conical cutting element may be selected to better align a normal or reactive force on the cutting element from the formation with the cutting tip axis or to alter the aggressiveness of the conical cutting element with respect to the formation. In a particular embodiment, the angle $\gamma$ formed between the cutting end or cone axis and the axis of the substrate may range from 37.5 to 45, with angle on trailing side being greater, by 5-20 degrees more than leading angle. Referring to FIG. 17, the backrake 165 of an assymetrical (i.e., oblique) conical cutting element is based on the axis of the conical cutting end, which does not pass through the center of the base of the conical cutting end. The strike angle 167, as described above, is based on the angle between the leading portion of the side wall of the conical cutting element and the formation. As shown in FIG. 17, the cutting end axis through the apex is directed away from the direction of the rotation of the bit.

Figure 16A:
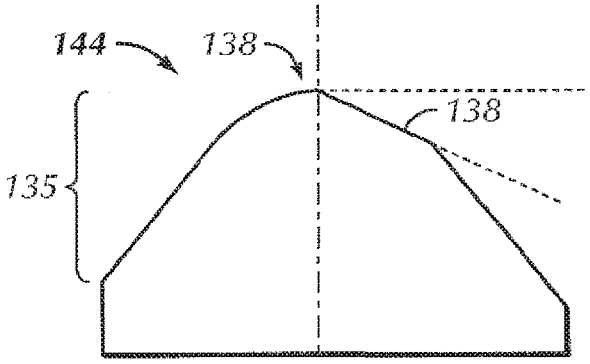
FIG. 16A-C shows various conical cutting elements according to the present disclosure.
Figure 16B:
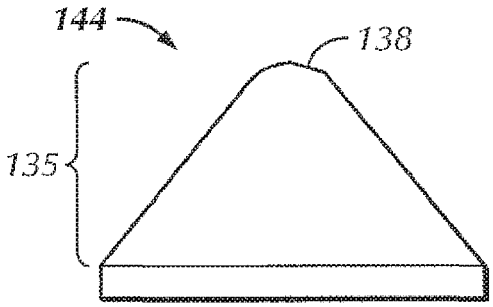
Figure 16C:
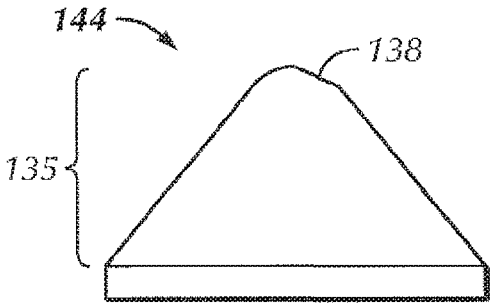

Referring to FIG. 16A-C, a portion of the conical cutting element 144, adjacent the apex 139 of the cutting end 135, may be beveled or ground off of the cutting element to form a beveled surface 138 thereon. For example, the slant cut angle of the bevel may be measured from the angle between the beveled surface and a plane normal to the apex of the conical cutting element. Depending on the desired aggressiveness, the slant cut angle may range from 15 to 30 degrees. As shown in FIGS. 16B and 16C, slant cut angles of 17 degrees and 25 degrees are shown. Further, the length of the bevel may depend, for example, on the slant cut angle, as well as the apex angle.

Figure 19:
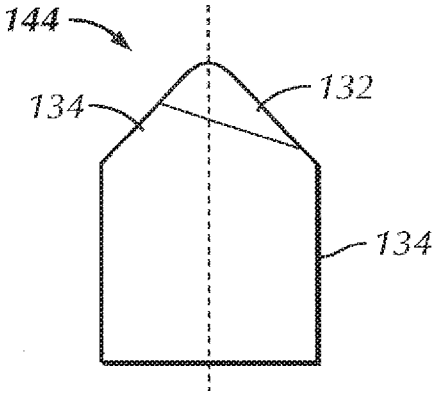
FIG. 19 shows an embodiment of a conical cutting element according to the present disclosure.

In addition to or as an alternative to a non-planar interface between the diamond layer 132 and the carbide substrate 134 in the conical cutting elements 144, a particular embodiment of the conical cutting elements may include an interface that is not normal to the substrate body axis, as shown in FIG. 19, to result in an asymmetrical diamond layer. Specifically, in such an embodiment, the volume of diamond on one half of the conical cutting element is greater than that of the other half of the conical cutting element. The selection of the angle of the interface with respect to the base may be selected, for example, based on the particular backrake, strike angle, apex angle, axis for the conical cutting end, and to minimize the amount of shear forces on the diamond-carbide interface and instead put the interface into greater compression stress than shear stress.

Figure 25:
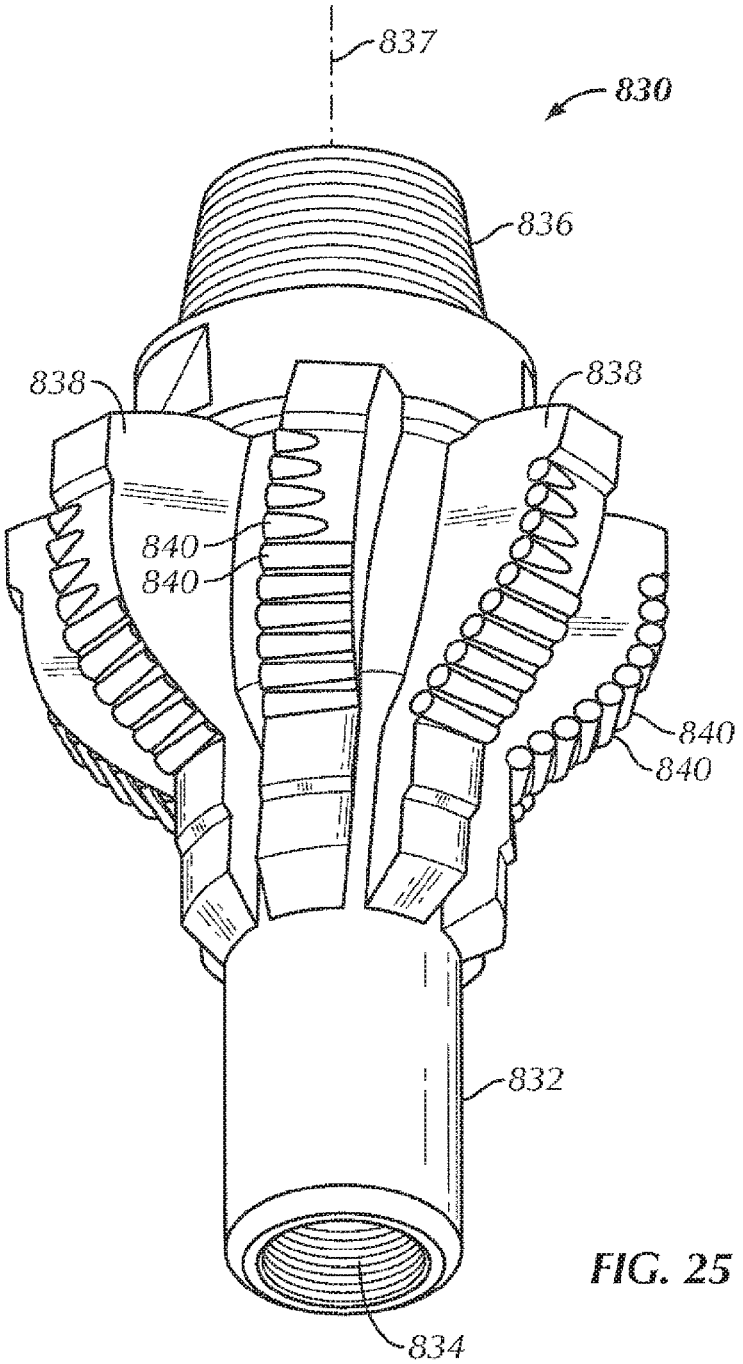
FIG. 25 shows a tool that may use the cutting elements of the present disclosure.

As described throughout the present disclosure, the cutting elements and cutting structure combinations may be used on either a fixed cutter drill bit or hole opener. FIG. 25 shows a general configuration of a hole opener 830 that includes one or more cutting elements of the present disclosure. The hole opener 830 comprises a tool body 832 and a plurality of blades 838 disposed at selected azimuthal locations about a circumference thereof. The hole opener 830 generally comprises connections 834, 836 (e.g., threaded connections) so that the hole opener 830 may be coupled to adjacent drilling tools that comprise, for example, a drillstring and/or bottom hole assembly (BHA) (not shown). The tool body 832 generally includes a bore therethrough so that drilling fluid may flow through the hole opener 830 as it is pumped from the surface (e.g., from surface mud pumps (not shown)) to a bottom of the wellbore (not shown). The tool body 832 may be formed from steel or from other materials known in the art. For example, the tool body 832 may also be formed from a matrix material infiltrated with a binder alloy.

The blades 838 shown in FIG. 25 are spiral blades and are generally positioned at substantially equal angular intervals about the perimeter of the tool body so that the hole opener 830. This arrangement is not a limitation on the scope of the invention, but rather is used merely to illustrative purposes. Those having ordinary skill in the art will recognize that any prior art downhole cutting tool may be used. While FIG. 25 does not detail the location of the conical cutting elements, their placement on the tool may be according to all the variations described above.

Moreover, in addition to downhole tool applications such as a hole opener, reamer, stabilizer, etc., a drill bit using cutting elements according to various embodiments of the invention such as disclosed herein may have improved drilling performance at high rotational speeds as compared with prior art drill bits. Such high rotational speeds are typical when a drill bit is turned by a turbine, hydraulic motor, or used in high rotary speed applications.

Additionally, one of ordinary skill in the art would recognize that there exists no limitation on the sizes of the cutting elements of the present disclosure. For example, in various embodiments, the cutting elements may be formed in sizes including, but not limited to, 9 mm, 13 mm, 16 mm, and 19 mm. Selection of cutting element sizes may be based, for example, on the type of formation to be drilled. For example, in softer formations, it may be desirable to use a larger cutting element, whereas in a harder formation, it may be desirable to use a smaller cutting element.

Further, it is also within the scope of the present disclosure that the cutters 142 in any of the above described embodiments may be rotatable cutting elements, such as those disclosed in U.S. Pat. No. 7,703,559, U.S. Patent Publication No. 2010/0219001, and U.S. Patent Application No. 61/351,035, all of which are assigned to the present assignee and herein incorporated by reference in their entirety.

Further, while many of the above described embodiments described cutters and conical cutting elements being located at different radial positions from one another, it is intended that a conical cutting element may be spaced equidistant between the radially adjacent cutters (or vice versa with respect to a cutter spacing between conical cutting elements), but it is also envisioned that non-equidistant spacing may also be used. Further, it is also within the scope of the present disclosure that a conical cutting element and a cutter may be located at the same radial position, for example on the same blade so that one trails the other.

Embodiments of the present disclosure may include one or more of the following advantages. Embodiments of the present disclosure may provide for fixed cutter drill bits or other fixed cutter cutting tools capable of drilling effectively at economical ROPs and in formations having a hardness greater than in which conventional PDC bits can be employed. More specifically, the present embodiments may drill in soft, medium, medium hard, and even in some hard formations while maintaining an aggressive cutting element profile so as to maintain acceptable ROPs for acceptable lengths of time and thereby lower the drilling costs presently experienced in the industry. The combination of the shear cutters with the conical cutting elements can drill by creating troughs (with the conical cutting elements) to weaken the rock and then excavated by subsequent action by the shear cutter. Additionally, other embodiments may also provide for enhanced durability by transition of the cutting mechanism to abrading (by inclusion of diamond impregnation). Further, the various geometries and placement of the conical cutting elements may provide for optimizes use of the conical cutting elements during use, specifically, to reduce or minimize harmful loads and stresses on the cutting elements during drilling.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A drill bit for drilling a borehole in earth formations, comprising:

a bit body having a bit axis and a bit face;

a plurality of blades extending radially along the bit face, the plurality of blades including a cone region, a nose region, and a shoulder region; and a plurality of cutting elements disposed on the plurality of blades, the plurality of cutting elements comprising:

a plurality of cutters comprising a substrate and a diamond table having a substantially planar cutting face; and a plurality of conical cutting elements comprising a substrate and a diamond layer having a conical cutting end, wherein in a rotated view of the plurality of cutting elements into a single plane, at least one cutter is located a radial position from the bit axis that is intermediate the radial positions of at least two conical cutting elements, and wherein conical cutting elements in the cone region have an exposure height, relative to each radially adjacent cutter, that is different than the exposure height of conical cutting elements in the shoulder region relative to each radially adjacent cutter, the difference being gradual or stepped.

2. The drill bit of claim 1, wherein the at least one cutter is disposed on a trailing blade relative to a first blade on which the at least two conical cutting elements are disposed.

3. The drill bit of claim 2, wherein the at least two conical cutting elements are on two separate blades.

4. The drill bit of claim 1, wherein the at least two conical cutting elements are on the same blade.

5. The drill bit of claim 1, wherein the at least two conical cutting elements are disposed in a nose region and shoulder region of a cutting profile.

6. The drill bit of claim 1, wherein the at least two conical cutting elements have a back rake ranging from about −10 to 10.

7. The drill bit of claim 1, wherein the at least two conical cutting elements have a backrake angle ranging from zero to 10.

8. The drill bit of claim 1, wherein at least one conical cutting element is set at a greater exposure height than a radially adjacent cutter.

9. The drill bit of claim 1, wherein the at least one conical cutting element is set at a lesser exposure height than a radially adjacent cutter.

10. The drill bit of claim 1, wherein at least one conical cutting element is set at substantially the same exposure height as a radially adjacent cutter.

11. The drill bit of claim 1, wherein the blades of the drill bit do not intersect a centerline of the drill bit.

12. The drill bit of claim 11, further comprising a center core cutting element disposed in a region between at least two blades.

13. The drill bit of claim 12, wherein the center core cutting element comprises a cutter.

14. The drill bit of claim 12, wherein the center core cutting element comprises a conical cutting element.

15. The drill bit of claim 1, wherein at least a portion of at least one blade comprises a plurality of superabrasive particles dispersed on a continuous matrix material.

16. The drill bit of claim 1, wherein the plurality of cutting elements further comprise at least one diamond impregnated insert inserted into a hole in at least one blade.

17. The drill bit of claim 16, wherein the at least one diamond impregnated insert is placed at substantially the same radial position and trailing at least one conical cutting element.

18. The drill bit of claim 1, wherein at least one of the at least two conical cutting elements comprises an axis of the conical cutting end that is not coaxial with an axis of the substrate.

19. The drill bit of claim 18, wherein an angle formed between the axis of the conical cutting end and the axis of the substrate ranges from 37.5 to 45.

20. The drill bit of claim 1, wherein at least one of the at least two conical cutting elements comprises a beveled surface adjacent the apex of the cutting end.

21. The drill bit of claim 20, wherein a slant cut angle of the beveled surface ranges from about 15 to 30 degrees.

22. The drill bit of claim 1, wherein the at least one cutter has a bevel ranging from about 0.001 to about 0.005 inches.

23. The drill bit of claim 1, wherein at least one of the at least two conical cutting elements comprises an asymmetrical diamond layer.

24. A downhole cutting tool, comprising:

a tool body having a tool axis;

a plurality of blades extending azimuthally from the tool body, the plurality of blades including a cone region, a nose region, and a shoulder region; and a plurality of cutting elements disposed on the plurality of blades, the plurality of cutting elements comprising:

a plurality of cutters comprising a substrate and a diamond table having a substantially planar cutting face;

a plurality of conical cutting elements comprising a substrate and a diamond layer having a conical cutting end; and at least one backup conical cutting element comprising a substrate and a diamond layer having a conical cutting end, wherein in a rotated view of the plurality of cutting elements into a single plane, at least one conical cutting element is located at a radial position from the tool axis that is intermediate the radial positions of at least two adjacent cutters, and wherein the at least one backup conical cutting element is on the same blade as and trails one of the at least two cutters and conical cutting elements in the nose region have an exposure height, relative to each radially adjacent cutter, that is different than the exposure height of conical cutting elements in the shoulder region relative to each radially adjacent cutter, the difference being gradual or stepped.

* * * * *